United States Patent [19]

Engle

[11] Patent Number: 4,633,793

[45] Date of Patent: Jan. 6, 1987

[54] APPARATUS FOR SEWING A CURVED SEAM

[75] Inventor: Elbert Engle, Ashville, Ala.

[73] Assignee: Chesebrough-Pond's Inc., Westport, Conn.

[21] Appl. No.: 571,120

[22] Filed: Jan. 17, 1984

[51] Int. Cl.[4] ..... D05B 19/00; D05B 27/00; B65G 25/00; B65H 39/00

[52] U.S. Cl. ..... 112/121.11; 112/121.15; 112/121.29; 112/308; 270/51; 270/58; 271/10; 271/258; 340/674

[58] Field of Search ..... 112/121.29, 121.26, 112/121.15, 121.11, 121.12, 304, 305, 306, 308, 309; 271/10, 19, 141, 18.3, 126, 258, 259, 277, 168; 270/52, 53, 56, 58; 340/675, 674; 26/96; 83/151, 155, 423

[56] References Cited

U.S. PATENT DOCUMENTS

| | | | |
|---|---|---|---|
| 37,687 | 2/1863 | Gordon . | |
| 186,423 | 1/1877 | Jacoby . | |
| 406,896 | 7/1889 | Frese . | |
| 1,065,309 | 6/1913 | Ginaca . | |
| 1,222,110 | 4/1917 | Lahti . | |
| 1,267,397 | 5/1918 | Garbow . | |
| 1,297,108 | 3/1919 | Cunningham . | |
| 1,800,604 | 4/1931 | Cluett | 26/96 |
| 2,235,960 | 3/1941 | Curtis . | |
| 2,252,735 | 8/1941 | Sherman | 83/423 |
| 2,568,028 | 9/1951 | Redmond | 83/151 |
| 2,619,175 | 11/1952 | Gottlieb | 271/18.3 |
| 2,896,944 | 7/1959 | Shuhei Shiba | 271/259 X |
| 2,916,899 | 12/1959 | Hepp et al. | 26/96 X |
| 2,947,917 | 8/1960 | O'Brien | 271/258 |
| 2,973,202 | 2/1961 | Schmeck et al. | 271/259 |
| 2,974,699 | 3/1961 | Boles et al. . | |
| 3,089,526 | 5/1963 | Lykkeberg | 83/423 |
| 3,140,736 | 7/1964 | Propst | 83/151 |
| 3,253,824 | 5/1966 | Southwell et al. | 271/19 |
| 3,289,510 | 12/1966 | Carter et al. | 26/96 X |
| 3,406,961 | 10/1968 | Walton | 271/10 |
| 3,456,537 | 7/1969 | Quinn . | |
| 3,514,352 | 5/1970 | Judge, Jr. | 26/96 X |
| 3,552,248 | 1/1971 | Pernick | 83/151 |
| 3,604,701 | 9/1971 | Hawley | 112/121.29 X |
| 3,611,961 | 10/1971 | Lopez | 112/121.29 X |
| 3,669,048 | 6/1972 | Dunn et al. | 112/121.26 |
| 3,765,672 | 10/1973 | Conner, Jr. | 271/10 |
| 3,841,623 | 10/1974 | McCarthy et al. | 271/126 |
| 3,866,499 | 2/1975 | Messner | 83/151 X |
| 4,049,257 | 9/1977 | Frystak | 271/126 X |
| 4,127,266 | 11/1978 | Williams | 271/277 X |
| 4,157,825 | 6/1979 | Ellenberger et al. | 271/10 |
| 4,203,590 | 5/1980 | Blessing | 271/277 |
| 4,214,741 | 7/1980 | Crawford | 271/277 |
| 4,283,047 | 8/1981 | Blessing | 271/18.3 |
| 4,343,255 | 8/1982 | Kelly et al. | 112/121.29 X |
| 4,348,018 | 9/1982 | Bijttebier et al. | 271/10 |

FOREIGN PATENT DOCUMENTS

| | | | |
|---|---|---|---|
| 2739653 | 3/1979 | Fed. Rep. of Germany | 271/258 |

OTHER PUBLICATIONS

Fabric Handling for Automated Manufacturing of Garments by R. Dubey and J. Parker.

Memo to: Dr. F. W. Paul from R. Dubey & J. Parker dated 10/15/81, Robotic Fabric Handling for Automated Garment Manufacturing by: Engineering Center for Automated Manufacturing Technology.

Fabric Handling for Automated Manufacturing of Garments 'CAM' 82-100, by: Mechanical Eng. Dept., College of Eng., Clemson University.

*Primary Examiner*—H. Hampton Hunter

*Attorney, Agent, or Firm*—Brumbaugh, Graves, Donohue & Raymond

[57] ABSTRACT

A microprocessor-controlled machine and method for automatically removing adjacent pieces from a stack of fabric plies, properly orienting these pieces adjacent one another, and joining these pieces by sewing at least one stitch or seam, to form a partially sewn garment such as a T-shirt sewn at the shoulder seams. The machine includes fabric positioning and engaging mechanisms, and a transport means for engaging and conveying fabric pieces while maintaining engaged portions thereof in predetermined alignment. The over-all machine includes three portions: a positioning portion having a plurality of movable platforms and a traveling carriage equipped with a powered roller that carries a fabric engaging mechanism; a sewing portion having a sewing machine, a plurality of platforms and a fabric transport mechanism that includes a pin chain for automatically engaging and transporting fabric past the sewing machine while maintaining the engaged fabric in proper alignment; and an unload/stacker portion for disengaging the partially sewn garment from the pin chain and automatically stacking same.

65 Claims, 33 Drawing Figures

APPARATUS FOR SEWING A CURVED SEAM

A microfiche appendix consisting of two microfiche having a total of sixty-seven frames is included as part of this specification. This appendix contains a source code listing of the computer programs used in the microprocessor based controller which operates a working physical embodiment of the apparatus disclosed herein.

The present invention relates to machines and methods for automatically handling and sewing garment portions.

BACKGROUND OF THE INVENTION

Children's T-shirts are commonly made from knit fabric, which is knitted in the shape of a relatively large diameter continuous tube. The fabric tube may include a pattern, such as continuous stripes of contrasting color running circumferentially around the tube. Such a fabric tube may be flattened and rolled up for storage upon a large spool. In the clothing factory, a spool of such fabric tube is unwound onto a cutting table and folded in zig-zag fashion to form a stack of fabric plies wherein the same flattened fabric surface faces upward and downward in alternate layers of the stack. The layers of fabric in the stack are then cut simultaneously using a pattern so that adjacent layers or plies of the stack will form the front and back pieces of a garment, such as a T-shirt. By retaining the adjacent plies together during the manufacturing process, it becomes possible to match the striping on the front and back pieces. Accordingly, each pair of adjacent layers of the cut fabric is used to form the front and back of a single garment.

Current manufacturing techniques utilize hand labor: (1) to separate adjacent front and back plies from the stack, (2) in some cases, to further cut the front ply near the neck opening, as is required in V-neck T-shirts for example, and (3) to then stitch the front and back plies along the shoulder seam with the outside surfaces of the front and back plies facing each other. The orientation of the inner and outer surfaces of the fabric plies during the sewing of the shoulder seam is the opposite of the orientation of those surfaces in the stack of cut fabric.

In this age of rising labor costs, such labor-intensive manufacturing techniques make the resultant garments increasingly expensive. Also, quality control is more difficult when the uniformity of output is dependent upon unwavering human attention to such highly repetitive handlabor tasks.

Automation of the above-identified hand labor operations would help garment manufacturers in countries where labor costs are relatively high to remain competitive in the face of lower hand labor costs elsewhere. It should also help improve productivity and quality control.

Accordingly, it is the principal object of the present invention to provide a machine and method for automatically removing adjacent front and back pieces from a stack of fabric plies, properly orienting and positioning these pieces adjacent one another, and joining these pieces together by sewing a shoulder seam.

It is also noted that handling, orienting, positioning and sewing are operations which typically each occur a number of times in the manufacture of most articles of clothing or other items made of fabric. Equipment and techniques used to automate any one of these operations, or any combination of these operations, may thus find application in various manufacturing situations in a clothing factory or the like.

Accordingly, it is an object of the present invention to provide an apparatus and method for automatically removing a top ply of fabric from a stack of fabric plies from a position and orienting it so that one surface of the fabric which was facing up is now in a position wherein the same surface faces down.

It is another object of the present invention to provide an apparatus and method for automatically aligning or mating two pieces of fabric adjacent one another so that the pieces may later be sewn together along at least one seam.

One other object of the present invention is to provide for a novel chain having pins projecting therefrom that is useful for automatically transporting fabric from one place to another.

Yet another object is to provide an apparatus and method for automatically transporting fabric or similar material in a selected path along a surface, such as through a sewing machine, while maintaining said fabric or material in proper alignment by use of the aforementioned pin chain.

Still another object of the present invention is to provide a machine which automatically performs all of the aforementioned objects without operator intervention beyond the loading of fabric stacks and unloading of stacked sewn garment portions, thereby making it feasible for a single operator to attend to a plurality of such machines.

SUMMARY OF THE INVENTION

In accordance with one aspect of the present invention there is provided an apparatus for use in handling fabric or similar material. The apparatus comprises a chain having a plurality of linked segments pivotable with respect to each other about a corresponding plurality of link connecting axes. There are provided a plurality of pin elements fixed to and extending from at least some of the segments substantially parallel to the axes.

The chain preferably includes connecting pins forming the link connecting axes, and the pin elements can be mounted in the connecting pins along at least some of the axes. The chain is preferably formed from a self-lubricating material, such as fiberglass reinforced nylon.

In accordance with another aspect of the invention there is provided an apparatus for transporting the fabric or similar material in a selected path along a surface. The apparatus comprises an endless flexible conveying member such as a belt or preferably a chain with a plurality of transversely extending pins and a groove on the surface along at least a portion of the path for receiving the ends of said pins. There is also provided means for supporting the conveying member adjacent the surface along the path with the pins extending into the grooves, and means for transporting the conveying member along the path.

Preferably, there may be provided a track for guiding the conveying member along the path. The transporting means may include a stepper motor connected to a rotary member such as a sprocket, gear or pully which engages the conveying member. In one aspect of the invention, at least a portion of the track extends along a curved portion of the path. At least a portion of the surface and the groove can be movable with respect to the chain and the pins to engage and disengage fabric on the surface portion.

In accordance with another aspect of the invention, there is provided an apparatus for transporting fabric or similar material along a selected path. This apparatus includes a supporting surface provided with first and second surface portions and having a groove extending across said surface portions which defines said path. The first surface portion is movable in a first direction substantially perpendicular to the supporting surface, and may also be made movable in a second direction substantially parallel to the surface for the purpose of positioning the fabric or similar material on the area of the surface about the groove. This transport apparatus also includes a transport mechanism comprising a flexible elongated carrier, such as a chain, belt, strap, or strip, having a plurality of transversely extending pins arranged substantially perpendicular to the supporting surface and extending into at least a portion of the groove, and means for supporting and transporting this carrier longitudinally along the selected path. The first surface portion is preferably provided with fabric engaging means for holding fabric thereon during positioning of the fabric relative to the groove. Such fabric engaging means may comprise vacuum apertures on the first surface portion and means for drawing air through said apertures. The groove may be constructed so that a portion thereof is curved, and said curve portion is preferably located on said first surface portion. The carrier supporting means may include a carrier supporting track, and the track may be curved to correspond to the curve of the groove. The transport apparatus may also be provided with a third surface portion and the groove from the first and second surface portions may extend across the third surface portion. The third surface portion is preferably movable in a direction perpendicular to the surface, and preferably includes fabric disengaging means carried thereon to disengage the fabric from the pins of the carrier.

In a different aspect of the invention, there is provided an apparatus for sewing a seam on at least one ply of fabric along a selected seam track on the fabric. This apparatus includes a supporting surface having an elongated groove defining a path, with the groove including a first segment in the form of the seam track. Also included in this apparatus is a sewing machine having a sewing platform. The sewing platform forms a portion of the supporting surface, and a second segment of the groove extends across the sewing platform. A transport mechanism comprising a chain of the type already described above is included in the apparatus and some of its pins extend into at least a portion of the groove, including the second segment of the groove. The supporting surface and transport mechanism are arranged to enable the pins of the chain to engage fabric along the first groove segment and transport the fabric along the second groove segment past the sewing machine in order to sew the fabric along the selected seam track. The supporting surface may be comprised of first and second surface portions including first and second groove segments respectively. The first surface portion may be made movable with respect to the transport mechanism to cause the pins of the chain to engage the fabric along the first groove segment. Further, the first groove segment and the seam track may be curved, while the second groove segment may be straight. Control means may be provided for operating the sewing machine and transport mechanism. The control means preferably includes a sensor coupled to the sewing machine for deriving signals representative of the speed of the sewing machine, and may also be provided with means responsive to said speed signals for operating the transport mechanism.

In one more aspect of the invention, there is provided an apparatus for mating two plies of fabric to be joined together. This mating apparatus includes a first receiving platform having an apertured end region, and a second receiving platform arranged below the first platform. A section of the second platform below the end region of the first platform is arranged for vertical motion toward the first platform and includes means for engaging fabric plys received thereon. The mating apparatus also includes means for positioning fabric plies at corresponding positions on said first and second receiving platforms. Accordingly, the fabric plies placed at the corresponding positions on the two platforms can be mated by raising the second platform portion and engaging the ply on the first platform to the ply on the second platform by use of the engaging means. The first receiving platform is also preferably horizontally movable between a first position directly above the second platform and a second position away from the second platform. The mating apparatus may also be arranged to position fabric on the first platform when it is in its first position, and on the second platform when the first platform is in its second position. The engaging means may comprise vacuum apertures on the second platform portion, and also may include means for selectively drawing air through these vacuum apertures. The second platform portion may also be further arranged for horizontal motion so that the fabric plies on the first and second platforms may be drawn together.

In accordance with still another aspect of the invention, there is provided an apparatus for removing from a stack of fabric plies the top ply of fabric. This apparatus comprises a first horizontal platform for supporting the stack of plies, a carriage arranged for horizontal movement over the first platform in a longitudinal direction with respect to the platform, and a roller mounted on and carried by the carriage. The roller has an axis transverse to the longitudinal direction. The roller is provided with fabric engagement means for engaging the top ply of fabric from the stack. Finally, there is provided operating means for transporting the carriage and rotating the roller in coordination to cause the roller to rollingly encounter the top ply and cause the engagement means to engage the top ply and draw the top ply about the roller and to cause the carriage to peel the engaged top ply of fabric from the stack.

In a preferred embodiment the fabric engagement means comprises pins protruding from the roller and having circumferentially oriented points spaced from the outer surface of the roller. The pins may be mounted in a radially extending mounting means carried by the roller and the pins can extend in a circumferential direction from the mounting means. The operating means may include means for horizontally transporting the carriage, means for rotating the roller and control means for controlling and coordinating the transporting means and the rotating means. The control means can operate in a first mode to rotate the roller driving means and operate the carriage transporting means in coordination to cause the rolling encounter with the top ply of fabric, and in a second mode to stop operation of the roller driving means and continue operation of the carriage transporting means to peel the engaged ply. The carriage transporting means and the rotating means may each include a stepper motor responsive to a programmed microprocessor in the control means. The first horizontal platform may be arranged for vertical motion with respect to the carriage and the control means cause the vertical portion of the horizontal platform to have a first roller engaging position when the roller encounters the top ply and a second, lower position with the stack spaced from the roller when the carriage peels the top ply from the stack.

Further, the apparatus may be provided with means for sensing the level of the top ply in its first position, and the control means can be responsive to the level sensing means. The first horizontal platform may also include a stepper motor for providing vertical motion, with the control means comprising a microprocessor that provides pulses to the stepper motor to raise the first platform until the level sensing means provides the microprocessor with an indication that the top ply is in the roller engaging position.

Yet another aspect of this invention is an apparatus for adjusting the level of the platform having a stack of plies of sheetlike material. This level adjusting apparatus includes a motor arranged to raise and lower the platform, and a level sensor having a vertically movable element and a vertically fixed element, with one of said elements having a magnet and the other having a magnetic field sensor. The movable element is arranged to engage an upwardly moving stack on the platform and to decrease the spacing between the magnet and the magnetic field sensor in response to an upward force applied to the movable element by the moving stack. The level sensing apparatus also includes a threshold circuit coupled to the magnetic field sensor for providing an output signal representing a selected magnitude of magnetic field, and a control circuit coupled to the magnetic field sensor and the motor for providing operating signals to the motor to raise the platform until the output signal is received from the threshold circuit. In a preferred embodiment, the motor comprises a stepper motor and the operating signals comprise pulses. The level sensor may be mounted on a support structure and movable with respect to the support structure between a first position where the movable element engages the stack, and a second position where the movable element is away from the stack.

In accordance with still another aspect of the invention, there is provided apparatus for removing and positioning single plies of fabric from a stack of fabric plies. The apparatus includes a support frame having transverse and longitudinaly horizontal directions. A first horizontal platform for holding the stack is mounted at one longitidual end of the frame and arranged for vertical movement with respect to the frame. First platform transport means are provided for adjusting the vertical position of the first platform. There is also provided a second horizontal platform mounted at the other longitudinal end of the frame for receiving the ply. A carriage is arranged for longitudinal horizontal motion with respect to the frame under the influence of a carriage transport means. A horizontal roller is mounted on the carriage with it roller axis in a transverse direction. The roller has a fabric engaging means and a roller driving means mounted on the carriage for rotating the roller about its axis. Finally, there is provided control means for operating the carriage transport means, the roller driving means, and the platform transport means in coordination to cause the platform transport means to position the first platform at a vertical position for engagement of the stack by the roller, to cause the carriage transport means and the roller driving means to operate in coordination and cause the roller to rollingly to engage the top ply of the stack and roll the top ply about the roller by a selected amount and to cause the roller driving means to stop while the carriage transport means continues to operate and the platform transport means lowers the platform by a selected amount thereby to cause the carriage means to peel the ply from the stack and to cause the carriage transport means to draw the ply onto the second platform and to cause the roller driving means to drive the roller in a reverse direction to disenage the ply on the second platform at a selected postion on the second platform.

Preferably, the carriage transport means the platform transport means and the roller driving means comprise stepper motors and the control means comprises a programmed microprocessor for operating the stepper motors. There may also be provided means for sensing the level of the top ply in the stack so that the control means can be responsive to the level sensing means controlling the platform trnasport means. In one embodiment there is provided a third horizontal platform for recieving the ply, the third platform being mounted at the other longitudinal end of the frame and arranged for transverse horizontal motion with respect to the frame between a first position over the second platform and under the path of the carriage and a second position away from the second platform, and wherein there is provided a third platform positioning means for moving the third platform between the first and second positions. The control means can control the third platform positioning means to cause the third platform to be in the first position and receive a ply from the roller and to be in the second position whereby the second platform receives a ply from the roller.

In accordance with another aspect of the invention, there is provided apparatus for mating first and second plies of material comprising a first horizontal platform for receiving the first ply of material, the first platform having at least a platform section which is arranged for vertical motion, the platform section including vacuum apertures for holding material. There is also provided a second horizontal platform for receiving the second ply of material, the second platform being arranged for horizontal motion between a first position vertically over the first platform and the first ply and a second position displaced from the first platform. The second platform includes vent means adjacent the section of said first platform for allowing air flow through the second platform to the apertures of the section. Accordingly, when the first and second plies are positioned on the first and second platforms, and the second platform is in the first position and when the first platform section is moved vertically to engage the second platform, a vacuum at the apertures may engage the first ply directly and engage the second ply through the vent means.

The first platform section may be further arranged for horizontal motion, thereby to transport the first and second fabric plies engaged by the vacuum apertures.

In accordance with the present invention there is further provided a sewing apparatus for positioning and sewing adjacent plies of fabric in a stack of fabric plies. The apparatus includes a support frame having transverse and longitudinal horizontal directions. A first support platform is mounted at one longitudinal end of the frame for holding the stack of fabric plies. The first platform is arranged for vertical motion with respect to the frame and includes a first platform transport means for adjusting the vertical position of the first platform. A second platform is provided at the other longitudinal end of the frame for receiving the fabric plies. The second platform has a platform section arranged for vertical motion with respect to the frame and also for longitudinal motion with respect to the frame. The second platform section also includes vacuum apertures for engaging fabric plies on the platform. There is provided second platform transport means for vertically positioning the second platform section and third platform transport means for longitudinally positioning the second platform section. There is also provided a third platform at the other longitudinal end of the frame for receiving fabric plies. The third platform is arranged for transverse motion with respect to the frame between a first position vertically above the second platform and a second position transversely displaced from the second platform. There is provided a fourth platform transport means for moving the third platform between the first and second positions. A vacuum control means is provided for selectively applying vacuum to the vacuum apertures of the second platform section. A carriage is arranged for longitudinal transport with respect to the frame over the first second and third platforms. There is provided a carriage transport means for moving the carriage longitudinally with respect to the frame. The carriage includes a roller mounted to the carriage and rotatable about the roller axis, said axis having a direction transverse with respect to the direction of carriage movement. Roller driving means for rotating the roller are provided and are carried by the carriage. The roller includes a fabric ply engaging mechanism. There is also provided a sewing machine mounted on the frame and a fabric engaging chain means mounted longitudinally adjacent said the other end of the frame for receiving fabric from the second platform section and for transporting the fabric past the sewing machine. There are provided means for driving the sewing and means for driving the chain. Finally, there is provided a control mechanism for (1) operating the first platform transport means to adjust vertical position of the first platform to a roller engaging position abutting a top ply of fabric on a stack on said platform; (2) operating the carriage transport means and the roller driving means in coordination to move the carriage from one end of the frame toward the other end while rotating the roller to provide rolling encounter with the top ply, to provide engagement of the top ply by the roller and wrapping of the top ply around the roller by a selected amount; (3) for discontinuing operation of the roller driving means while continuing opertion of the carriage transport means and operating the first platform transport means to lower the first platform by a selected amount thereby to peel the first ply from the stack; (4) for continuing operation of the carriage transport means while drawing the first ply over the third platform in the first position and selectively operating the roller driving means in a reverse direction to release the first ply in a selected position on the third platform; (5) for reversing the carriage transport means to return the carriage from the other end of the frame to the one end; (6) for operating the fourth platform transport means to move the third platform to its second position; (7) for operating the first platform transport means to adjust the first platform to the roller engaging position; (8) for operating the carriage transport means and the roller driving means in coordination to move the carraige and the roller to engage and wrap a second ply around the roller by the selected amount; (9) for discontinuing operation of the roller driving means while operating the carriage transport means and the first platform transport to peel the second ply from the stack; (10) for operating the carriage transport means and the roller driving means to release the second ply in a selected position on the third platform; (11) for reversing the carriage transport means to return the carriage to the one end; (12) for operating the fourth platform transport means to move the third platform the first position; (13) for operating the second platform transport means to adjust the level of the second platform section to engage the third platform; (14) for operating the vacuum control means to engage the first and second ply by the vacuum apertures on the second platform section; (15) for operating the third platform transport means to transport the second platform section and the plies to the chain means; (16) for releasing operating of the vacuum control means; (17) and for operating the chain driving means and the sewing machine driving means to transport the plies past the sewing machine and sew said plies.

For a better understanding of the present invention, together with other and further objects, reference is made to the following description, taken in conjunction with the accompanying drawings, and the scope of the present invention will be pointed out in the appended claims.

DESCRIPTION OF THE INVENTION

Figure 1:
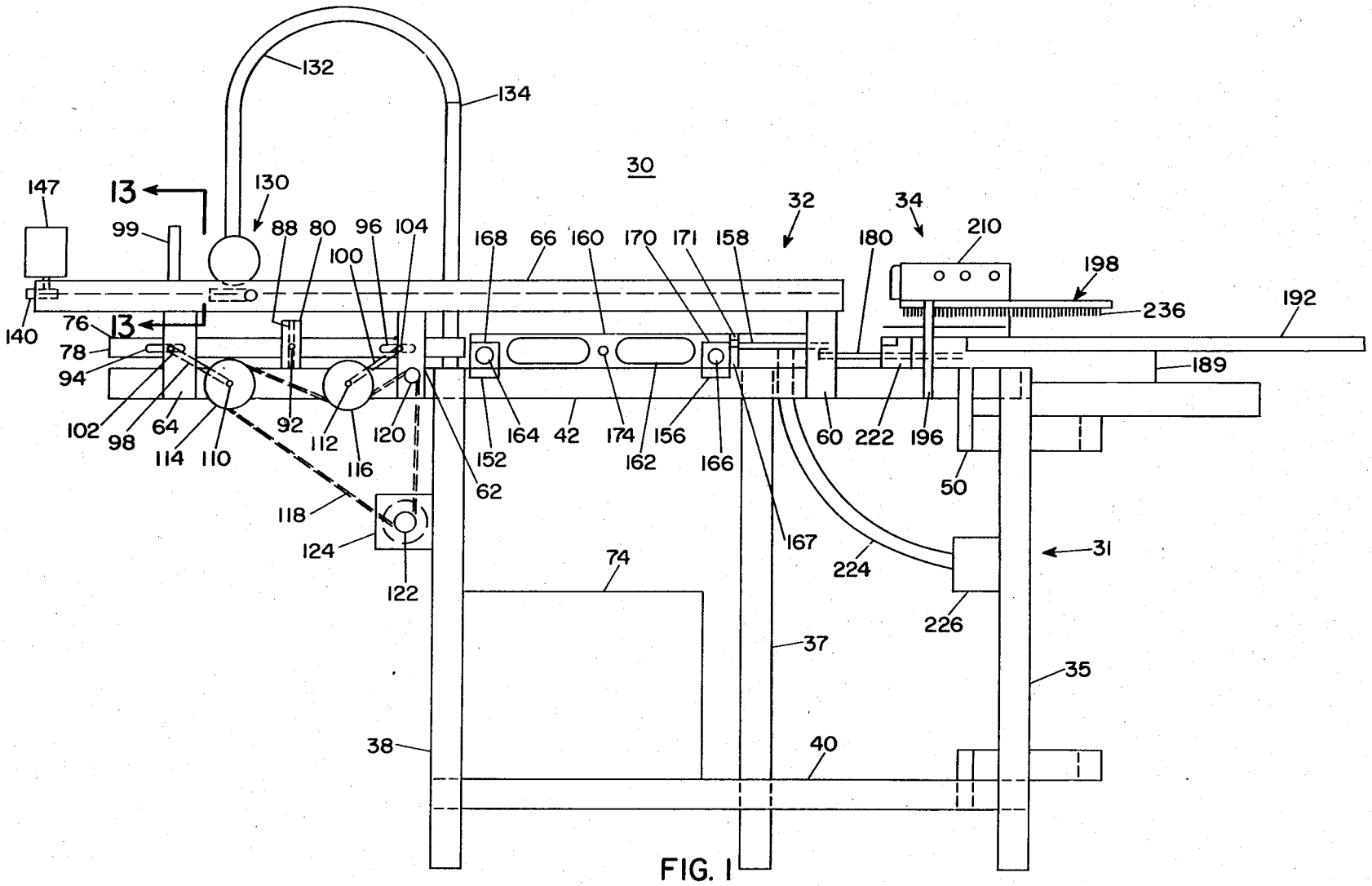
FIG. 1 is a side elevational view of an apparatus in accordance with the present invention.

Referring generally to FIGS. 1 and 2, an apparatus 30 in accordance with the present invention is shown for taking plies of fabric from a stack of cut fabric, positioning the fabric plies and sewing them together to form joined front and back portions of a garment, such as a shirt. The illustrated embodiment is particularly adapted for operating on a stack of fabric plies cut from tubular knitted fabric wherein alternate plies from the stack are to form the front and back portions of a shirt. In the stack of fabric plies, as cut and supplied to the apparatus, the top layer or ply of fabric is to form the front of a shirt and has the outer side or surface of the fabric facing upward. The next layer or ply of fabric will form the back of the same shirt and has its outer surface facing downward. Succeeding pairs of alternate plies will each form the front and back of another shirt. Prior to the sewing operation, it is necessary to position the front and back of each pair of plies, which involves orienting the front and back of each pair of plies so that their outer surfaces face each other, and mating the front and back so that the fronts and backs are properly aligned in the area that is to form the shoulder seam.

Figure 2A:
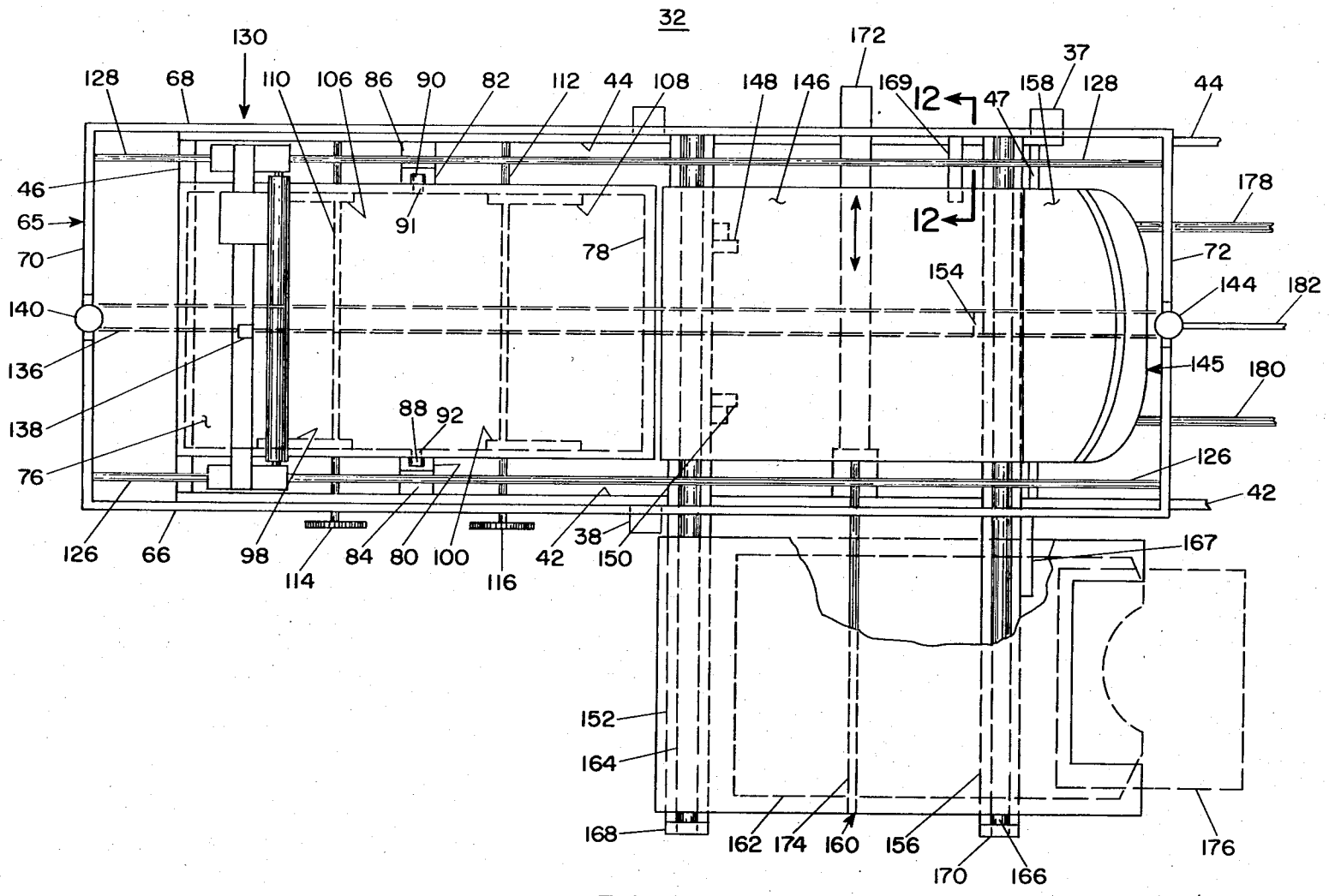
FIG. 2 is a top view of the apparatus of FIG. 1, with FIG. 2A showing the positioning portion of the apparatus, and FIG. 2B principally showing the sewing portion and the unload/stacker portion of the apparatus.
Figure 2B:
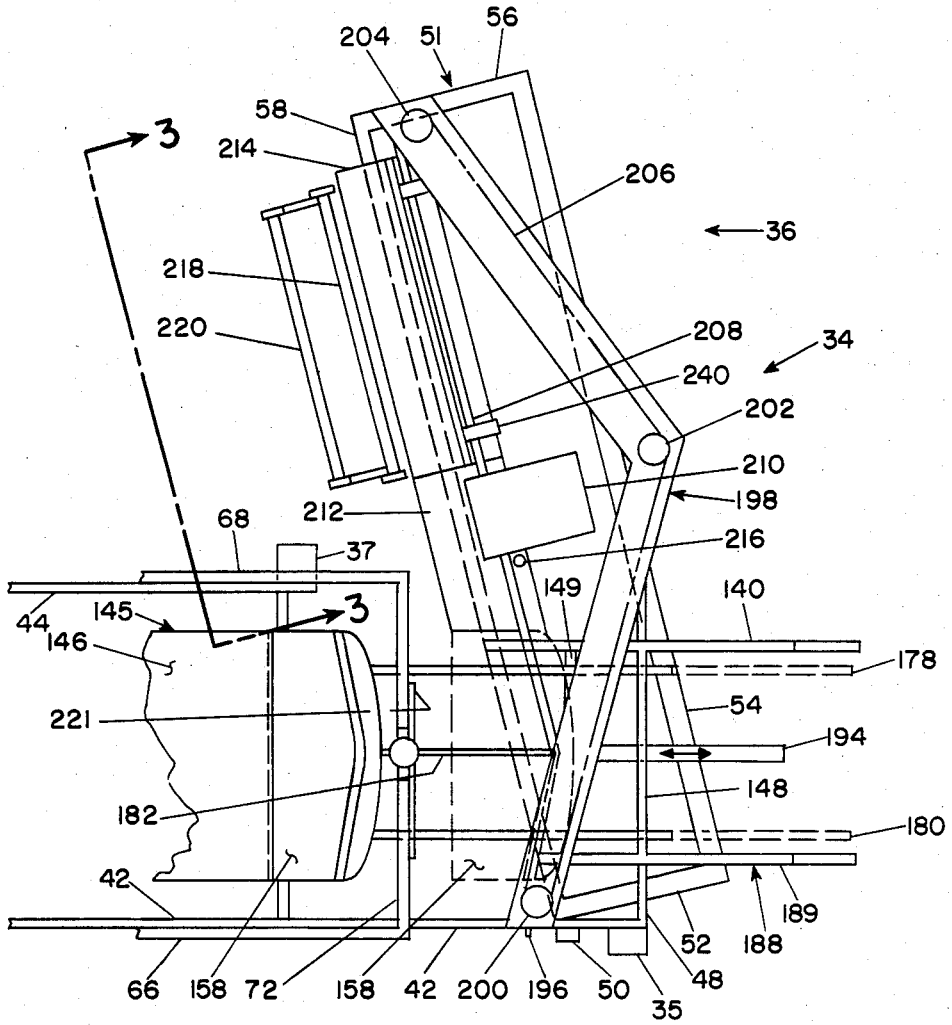

FIG. 1 is a side view of the overall apparatus 30, and FIGS. 2A and 2B are overlapping top views of two portions of the apparatus. The positioning portion 32 of apparatus 30 shown in FIG. 2A functions to position a pair of fabric plies from a stack of cut fabrics as required for the shoulder seam sewing operation, that is with their outer surfaces facing each other and with their shoulder edges aligned. The sewing portion 34 of apparatus 30 shown in the top view of FIG. 2B serves the function of receiving the oriented and aligned shirt portions from positioning portion 32 and sewing the shirt portions along the shoulder seam. The unload/-stacker portion 36 of apparatus 30 shown in FIG. 2B serves the function of unloading and vertically stacking the sewn shirt portions on top of the previously sewn pairs of shirt portions. The entire machine 30 is designed to automatically perform the aforementioned functions without the assistance of an operator other than loading the stack of cut front and back pieces onto the machine and unloading the stacked sewn shirt portions from the machine.

Apparatus 30 includes a roughly L-shaped table-like support frame 31, which supports positioning portion 32 of apparatus 30, illustrated in top view in FIG. 2A, and sewing portion 34 and unload/stacker portion 36 of apparatus 30, illustrated in top view in FIG. 2B. Table frame 31 includes vertical support members or legs 35, 37 and 38 visible in FIG. 1 as well as other vertical support members (not shown) as required. Vertical support members are braced together with a lower horizontal support member or shelf 40 which also provides a mounting structure for an electronic package or controller 74 for use in controlling the operation of the machine. At the upper ends of legs 35, 37 and 38, there are provided horizontal frame members 42, 44, which run longitudinally with respect to the frame, and transverse frame members 46, 47 and 48, which are located at the rear end, middle and front end of frame 31 respectively. Table frame 31 supports further vertical members 60, 62 and 64 and matching vertical members on the opposite side, which in turn support an upper rectangular frame 65 (hereinafter called the carriage frame 65) that is formed by longitudinal members 66, 68 and transverse members 70, 72. The front end of table frame 31, which supports sewing portion 34 of apparatus 30, also includes further support members connected to horizontal table frame member 42 by vertical member 50 and comprising a frame structure or base 51 for sewing and unload portions 34 and 36. Sewing portion base 51 is comprised of members 52, 54, 56 and 58, which are shown in FIG. 2B, diagonally connected by member 50 to table frame member 42 and extending generally transversely therefrom.

Towards the rear of table frame 31 as shown in FIGS. 1 and 2A, there is provided a first platform 76 for receiving and supporting a stack of fabric plies of the type previously described. For reasons which become apparent, platform 76 is sometimes referred to as the elevator. Preferably, first platform 76 is a removable tray in the form of a metal sheet. Platform 76 is supported by a rectangular bed 78 of two longitudinal and two transverse members. Bed 78 is held in longitudinal position with respect to table frame 31 by vertical support members 80 and 82 which are provided with inwardly facing slots 88 and 90 to retain outwardly extending cylindrical teflon knobs 91 and 92 mounted on each side of bed 78. Vertical supports 80 and 82 are respectively mounted on horizontal members 84 and 86 which are connected to horizontal frame members 42 and 44 respectively.

Vertical positioning of first platform 76 is provided by lever arms 98, 100, 106 and 108 which at one end are rigidly connected to axles 110 and 112 that extend transversely between and are rotatably supported by table frame members 42 and 44. The other ends of levers 98, 100, 106 and 108 are provided with outwardly facing cylindrical teflon cams 102, 104 which are slidably engaged in slots 94, 96 located in the longitudinal members of bed 78. Axles 110, 112 are respectively rigidly connected to axle sprockets 114, 116. Sprockets 114, 116 are connected by chain 118 to idler sprocket 120 and drive sprocket 122. Sprocket 122 is connected to stepper motor 124 which when operated provides vertical adjustment of platform 76.

Figure 13:
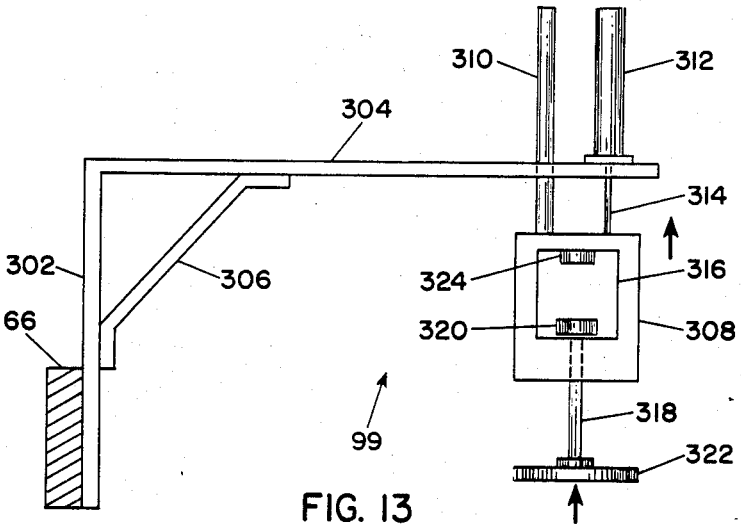
FIG. 13 is a detailed end view of a stack level sensing apparatus and its supporting structure.

Mounted on carriage frame member 66 is a stack level sensing apparatus 99, which may be seen in FIG. 1 and is shown in further detail in FIG. 13. The stack level sensing apparatus 99 is used in conjunction with stepper motor 124 for adjusting the position of first platform 76 so that the topmost layer of fabric in the fabric stack will engage at a proper level a pickup roller mounted on carriage 130 which will be further described. Referring to FIG. 13, the level sensing apparatus 99 includes vertical and horizontal support members 302, 304 which are connected by support brace 306. Guide log 310 slidably protrudes through horizontal support 304 and guides the upward and downward motion of a sensor body 308 which is produced by cylinder rod 314 being operated by air cylinder 312. Sensor body 308 includes an opening 316 within which is located a magnetic field sensor 324. Rod 318 is mounted in and freely slides through a vertical bore that passes through member 308 so that as a stack of fabric upon platform 76 is moved upward, thereby contacting and raising pad 322, magnet 320 at the top end of rod 318 will move toward sensor 324. Sensor 324 may be a Hall effect IC device having an analog output proportional to the sensed magnetic field strength, such as Microswitch Model No. 713SS21-2. When a selected threshold level of magnetic field from magnet 320 is detected by sensor 324, controller 74 will stop the upward motion of stepper motor 124 so that the stack of fabrics will be at a desired selected elevation with respect to table frame 31, and, therefore, with respect to carriage 130 as well.

Towards the center of table frame 31, there is provided a second platform 160 and a third platform 145 having a rear section 146 and a front section 158. The second platform 160, which is sometimes called the cut plate, is arranged to move transversely with respect to table frame 31 between a first or returned position directly above third platform 145, and a second or advanced position transversely spaced away from third platform 145 as shown in FIG. 2A. When both platforms are in their returned positions, the vertical spacing between the top surfaces of platforms 145 and 160 preferably is approximately a half inch. Referring again to FIGS. 1 and 2A there are provided for the support of second platform 160 transverse support members 152, 156, which are mounted to longitudinal table frame members 42, 44, and extend outwardly therefrom, terminating in end blocks 168, 170. Positioned above and supported by end blocks 168, 170 are support rods 164, 166 upon which platform 160 slides. For purposes of clearly illustrating the foregoing support structure of platform 160, platform 160 is shown partially broken away in FIG. 2A.

Figure 11:
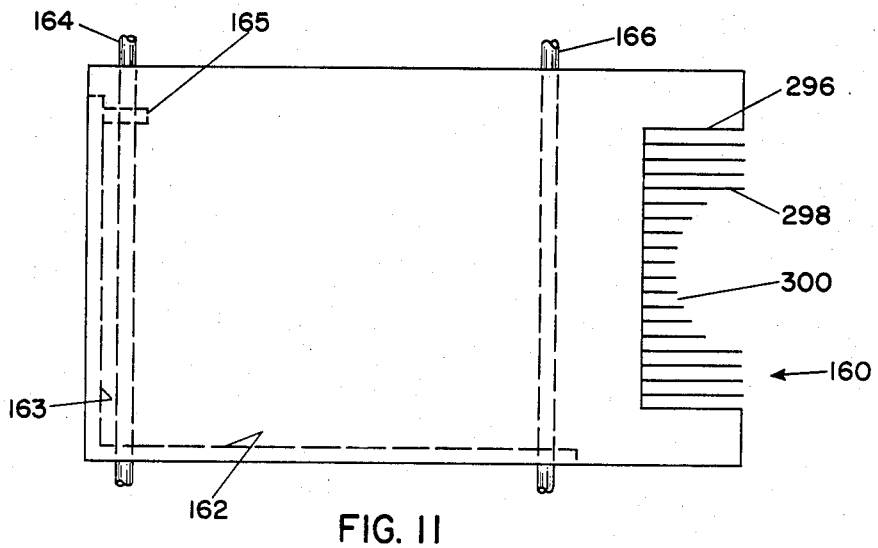
FIG. 11 is a plan view of the second platform of the apparatus shown in FIG. 1.

Platform 160 is separately illustrated in detail in FIG. 11 and includes an L-shaped bracket having longitudinal member 162 and transverse member 163 supporting the rear edge and outside edge of platform 160. Transverse member 163 has a support bearing 165 riding upon support rod 164. Longitudinal member 162 bears on rods 164, 166 and is connected to cylinder rod 174 of cylinder 172, which provides lineal motion for platform 160 between its first position directly above third platform 145 and its second position spaced transversely apart from platform 145.

Figure 12:
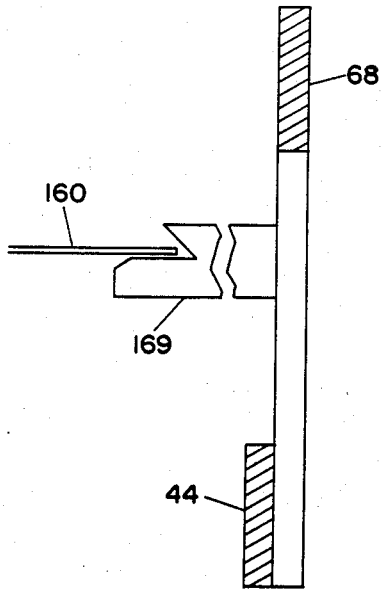
FIG. 12 is a fragmentary side view in cross-section taken along lines 12—12 of FIG. 2A of a rest or support member for the second platform shown in FIG. 11.

When platform 160 is in its first position, the edge of the platform opposite longitudinal bracket member 162 is supported by a first rest 169, shown in FIG. 2A, which is preferably made of teflon. FIG. 12 is a detailed view of first rest 169. When platform 160 is not in its first position, its front edge is supported by a second rest 167 having a teflon top 171 that is mounted on transverse member 156, as shown in FIGS. 1 and 2A.

Referring again to FIG. 11, the front part of second platform 160 is provided with a rectangular cut-out 296 having a plurality of longitudinal prongs 298, each preferably formed of spring steel and having a width of approximately 3/32 of an inch. Prongs 298 have a cut-out 300 shown in semi-circular shape (but which may be changed to other desired shapes) to permit the cutting of a fabric ply resting on second platform 160 when the platform is in its second position. Accordingly, when platform 160 is in its second position, transversely displaced from third platform 145 as shown in FIG. 2A, it is possible to reshape the neck portion of the shirt front resting on platform 160 by use of a suitable cutting apparatus positioned as shown by dotted lines 176 or in any other suitable position. Prongs 298 serve to support the forward part of fabric ply on platform 160 and also to facilitate removal of the fabric ply from the platform by allowing air to pass through the fabric ply, as will be further described.

Third platform 145 includes rear platform section 146 and front platform section 158, which is sometimes called the vacuum plate. Rear section 146 is supported in the rear by pivot means such as hinges 148 and 150 that are attached to transverse support member 152, and in the front by a center rest 154 that is attached to transverse member 156, as is shown in FIG. 2A. The front edge of rear section 146 abuts and is additionally supported by a notch in the rear edge of front section 158 which will be further described shortly. The foregoing support for section 146 thus enables section 146 to pivot on hinges 148 and 150 through a short arc as will be further described in conjunction with FIGS. 19A and 19B.

Figure 6:
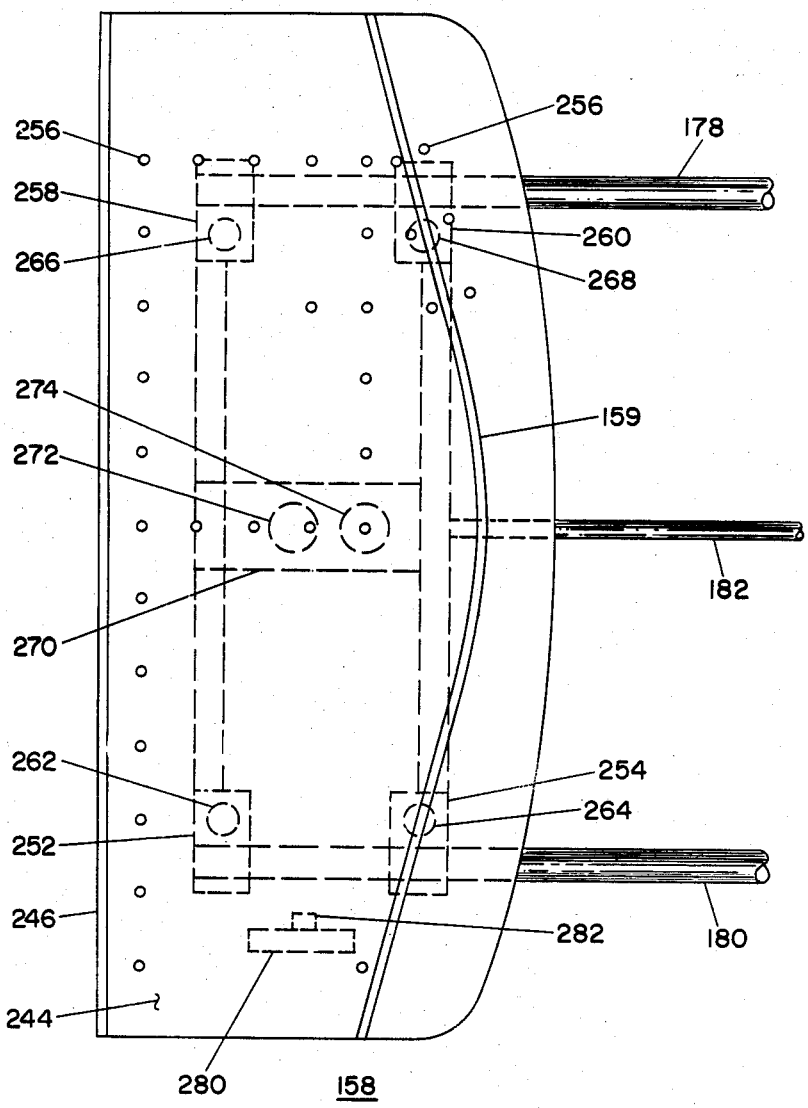
FIG. 6 is a detailed top view of the front section of the third platform of the positioning portion of the apparatus.
Figure 7:
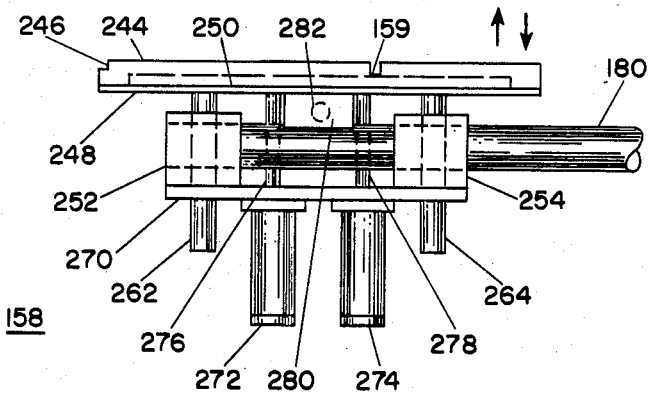
FIG. 7 is a side view of the subject matter illustrated in FIG. 6.

Third platform section 158 is illustrated in general in FIGS. 1 and 2B and in detail in FIGS. 6 and 7. Platform section 158 is arranged to move vertically between three positions and horizontally between two positions. Platform section 158 is comprised of generally planar deck piece 244 having a hollow interior 250 and cover plate 248 rigidly attached to the lower side of deck 244 and covering its hollow interior. Platform section 158 is rigidly connected to vertical support rods 262, 264, 266 and 268 which extend downwardly therefrom through and in slidable engagement with support blocks 252, 254, 258 and 260 respectively. These four support blocks are rigidly connected to and joined together by H-shaped frame 270. Blocks 252 and 254 are rigidly coupled to and ride horizontally upon movable longitudinal support rod 180, while blocks 258 and 260 are rigidly coupled to and ride horizontally upon movable longitudinal support rod 178. Rods 178 and 180 are slidably connected to and supported by frame structure 188. Frame structure 188 includes longitudinal members 189, 140 and two transverse members 148, 149 interconnecting members 189 and 140 and is rigidly attached to and supported by frame structure 51. Longitudinal horizontal movement is imparted to platform section 158 through cylinder rod 182 projecting from and driven by air cylinder 194 that is rigidly attached to frame structure 188 where shown in FIGS. 2B and 18. Under motive force from cylinder 194, platform section 158 moves back and forth between a first or returned position illustrated in solid lines in FIGS. 2A and 2B wherein section 158 is contiguous with platform section 146 to a second or advanced position illustrated in dotted lines in FIG. 2B wherein section 158 is contiguous with sewing platform 212. Platform section 158 is thus able to transport fabric between the positioning portion 32 and sewing portion 34 of apparatus 30 in a manner that will be more fully explained below.

Referring now to FIGS. 6 and 7, the manner in which vertical motion is imparted to platform section 158 may be explained. Air cylinders 272 and 274 are rigidly and centrally attached to H-frame 270. Cylinder rod 276 of cylinder 272 is attached to cover plate 248, while cylinder rod 278 of cylinder 274 bears against but is not attached to cover plate 248. Platform section 158, under the motive force supplied by cylinders 272 and 274, is movable between three vertical positions, namely a first or fully lowered position (also called the returned position), a second or middle position and a third or fully raised position. The travel of section 158 between each successive position preferably is approximately one half of an inch. Cylinder 274 is used to raise platform section 158 between the fully lowered and middle positions, while cylinder 272 is used to raise section 158 between the middle and fully raised positions. To move section 158 from its fully raised position to its fully lowered position, both rods 276 and 280 of cylinders 272 and 274 must be lowered.

Hollow interior 250 of platform section 158 serves as a manifold for the distribution of vacuum to sundry apertures arranged in roughly uniform fashion over a substantial portion of deck 244 as indicated by several representative apertures 256 shown in FIG. 6. Vacuum manifold 250 is sealed from the bottom by cover plate 248, which has a suitable fitting (not shown) for connecting vacuum hose 224 to vacuum control valve 226 as indicated in FIG. 1.

Deck 244 of platform section 158 is provided with a groove 159, preferably of U-shaped cross-section, for receiving the ends of pins on the pin chain of sewing portion 34, as will further be described. Groove 159 as viewed from above in FIG. 6 extends in an obtuse V-shape across the width of section 158. It is to be appreciated that the path chosen for groove 159 across the width of section 158 will be dependent upon the geometry of the seam to be sewn.

Attached to the lower surface of cover plate 248 is support block 280 having a cylindrical projection 282 preferably made of teflon, which helps guide second platform section 158 as it moves forward in its middle vertical position while transporting fabric from positioning portion 32 to sewing portion 34. Projection 282 slips into a complementary opening provided in end guide 222 which is attached to the rear of support structure member 189 as may be seen in FIG. 1. End guide 222 is shown in further detail in FIGS. 8 and 9. As platform section 158 moves forward, projection 282 passes under cam surface 286 of end guide 222 and comes to rest below vertical channel 284. For reasons which will be explained in more detail later, platform section 158 is then moved to its fully raised position and projection 282 accordingly passes into channel 284, thus helping to ensure proper alignment of platform section 158 and groove 159 thereon with sewing platform 212 and groove 213 thereon to help prevent possible damage to the pin chain from misalignment of grooves 159 and 213.

As shown in FIGS. 6 and 7, the rear edge of deck 244 of section 158 is also provided a long transverse notch 246 for engaging and lifting the front edge of rear section 146 of third platform 145, for reasons which will become more apparent further on in this specification.

Referring again to FIGS. 1 and 2A, there is provided a carriage apparatus 130 which is connected to controller 74 via electric cable harness 132 running up mast 134. Another mast for harness 132 may be provided if desired on carriage 130. Carriage 130 is arranged to move back and forth longitudinally on tracks 126 and 128 between carriage frame ends 70 and 72 under the power provided by stepper motor 147. As shown in FIG. 2A, carriage chain 136 is fixedly connected to a mounting bracket 138 on carriage 130 and driven by a stepper motor 147 (shown only in FIG. 1) mounted on frame member 70, which drives sprocket 140. Mounted on frame member 72 is an idler sprocket 144 for supporting the other end of chain 136.

Figure 14:
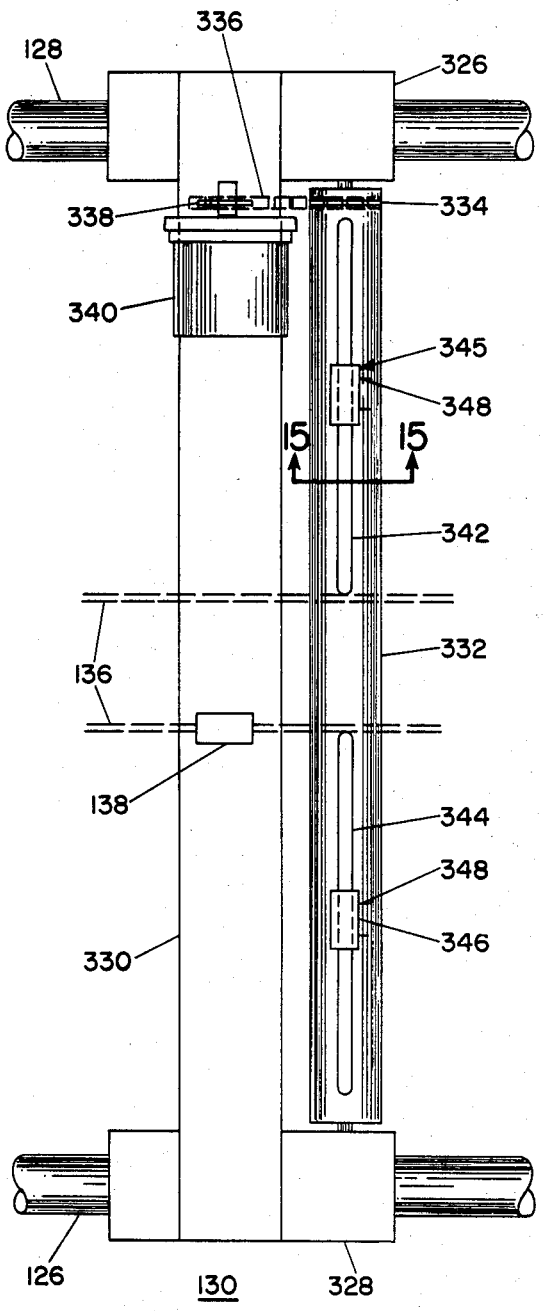
FIG. 14 is a fragmentary plan view of the carriage of the apparatus shown in FIGS. 1 and 2.

Referring to FIG. 14, a detailed top view of carriage 130 is shown. Carriage 130 includes side support members 326 and 328 which are glideably coupled to and bear on tracks 126 and 128, which may be cylindrical steel rods. Crossbeam 330 extends transversely between members 326 and 328 and includes mounting bracket 138 which is rigidly clamped to chain 136 to provide for longitudinal motion of carriage 130 back and forth on tracks 126 and 128 as chain 136 moves. A cylindrical roller 332 is mounted to support members 326, 328 for rotation about its axle which is horizontally and perpendicularly positioned with respect to side members 66 and 68 of carriage frame 65. A stepper motor 340 is mounted rigidly on crossbeam 330. The rotor shaft of motor 340 is connected to and drives sprocket 338, which is connected by chain 336 to sprocket 334, which is directly coupled to and axially aligned with roller 332. Thus, roller 332 can be rotated about its axle by control of stepper motor 340. Roller 332 is provided with a fabric ply engaging mechanism 345 such as a plurality of projecting pins 348, which extend in a tangential direction from roller 332. Longitudinal slots 342 and 344 in roller 332 carry support members 346 which hold projecting pins 348 stationary with respect to the roller.

Figure 15:
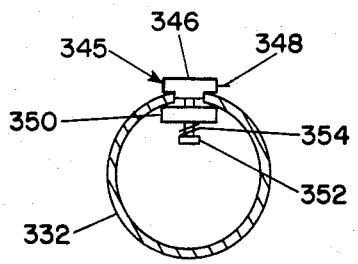
FIG. 15 is a side view in cross-section taken along line 15—15 of FIG. 14 of the roller and fabric engaging mechanism mounted on the carriage.
Figure 16:
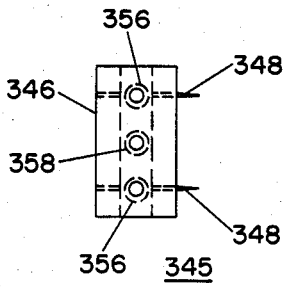
FIG. 16 is a top view showing the fabric engaging mechanism of FIG. 16.

FIG. 15 is a transverse cross-sectional view of roller 332 illustrating the mounting of fabric ply engaging mechanism 345 in slot 342, and is also illustrated in enlarged plan view in FIG. 16. Support member 346 includes a pair of set screw holes 356 for set screws (not shown) for holding pins 348 in place. Threaded central hole 358 is provided in member 346 for screw 352, which carries spring 354. Pressure applied by spring 354 against inside member 350 and screw 352 holds support member 346 in fixed longitudinal position on slot 346 during normal operation of apparatus 30, while also permitting easy longitudinal adjustment of member 346 when setting up carriage 130 for fabric plies of different widths. In practice, additional openings may be provided on roller 332 opposite slots 342 and 344 to facilitate mounting of pin support members 346 and 350.

Figure 10:
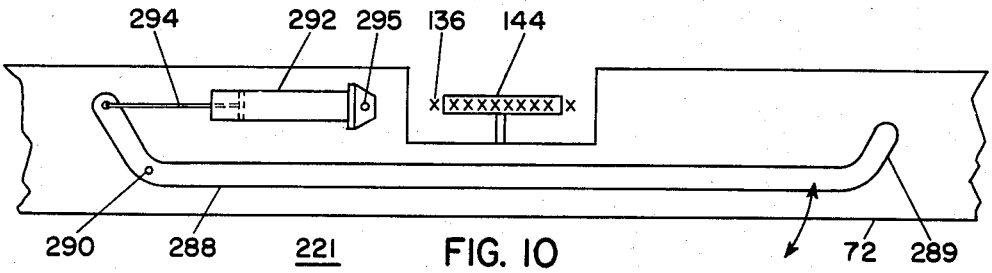
FIG. 10 is a fragmentary end view of a fabric pull-off mecnanism.

As indicated in FIG. 2B and illustrated in FIG. 10, a fabric pull-off mechanism 221 is mounted on transverse member 72 of table frame 31 to assist in removing fabric plies from platform 160 and from rear section 146 of platform 145 after the fabric plies have been transported from positioning portion 32 to sewing portion 34 of apparatus 30. Mechanism 221 includes a lever 288 pivotably connected in first class lever fashion to a fulcrum point or knob 290 and cylinder rod 294 of cylinder 292. Cylinder 292 is itself pivotally attached at its cap end to member 72 by bolt 295. Retracting cylinder rod 294 into cylinder 292 causes the unsupported end 289 of lever 288 to swing downward where it may contact any fabric positioned horizontally therebelow. Extending cylinder rod 294 returns lever 288 to its original position shown in FIG. 10.

Sewing portion 34 of the illustrative apparatus 30 will now be described with respect to FIGS. 1, 2B, 3, 4, 5, 6 and 17. As best shown in FIG. 2B, sewing portion 34 includes front section 158 of third platform 145, a fourth or sewing platform 212, sewing machine 210 mounted adjacent and above platform 214, chain support structure 198 including chain guide 208, structural frame 188 previously described with respect to platform section 158, and sewing portion base 51. As previously described, front section 158 of third platform 145 may be longitudinally moved via operation of cylinder 194. The forward motion of section 158 is used to move fabric plies between positioning portion 32 and sewing portion 34 of the apparatus 30. Platform section 158 is provided with a groove 159, having an obtuse V-shaped configuration as previously explained in connection with FIG. 6. Groove 159 in section 158 cooperates with a specially designed chain 206, commonly called the pin chain, on sewing portion 34 for engaging fabric plies held on platform section 158 by action of vacuum suction through vacuum apertures 256 shown in FIG. 6. Once the fabric plies have been so engaged, the vacuum may be turned off, and pin chain 206 and groove 159 will maintain the plies in the desired alignment.

Figure 3:
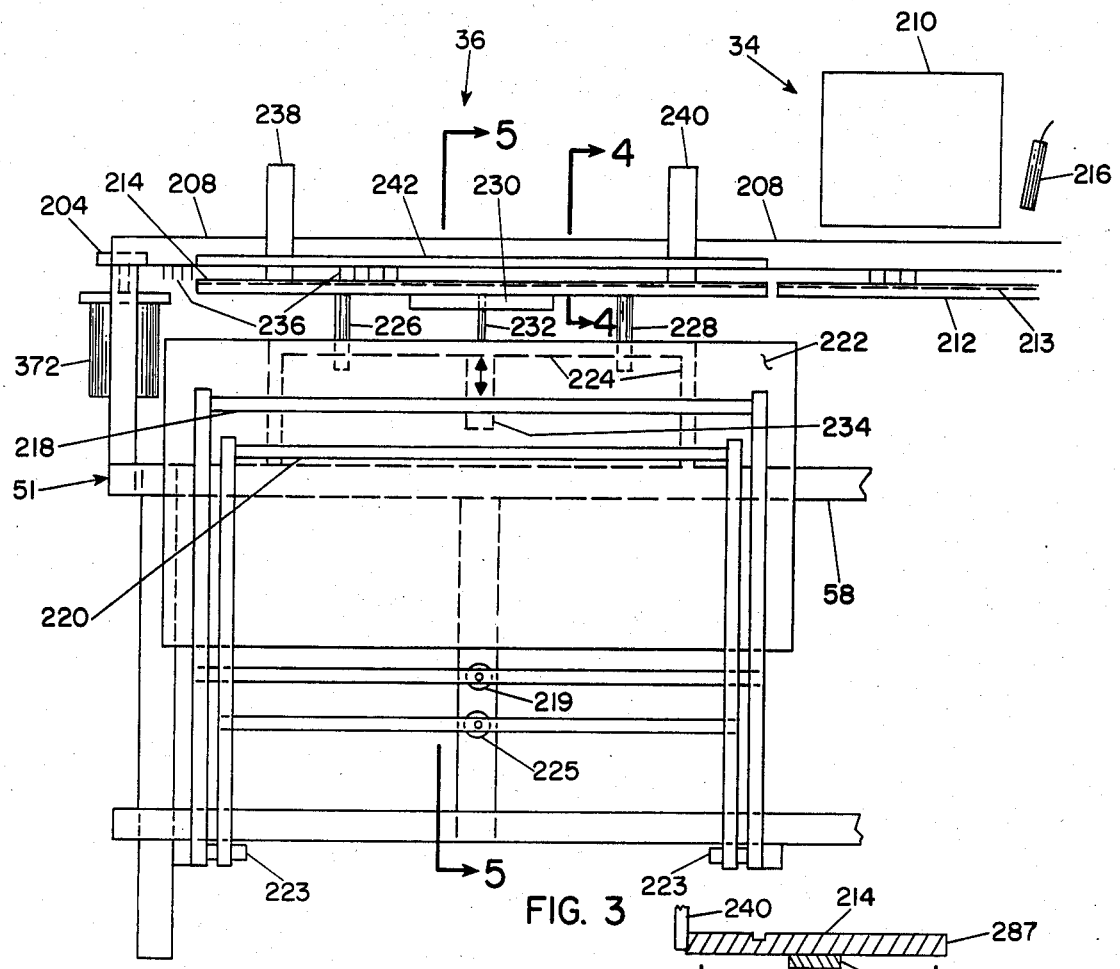
FIG. 3 is a partial end elevational view along line 3—3 in FIG. 2B showing the unload/stacker portion and part of the sewing portion of the apparatus illustrated in FIG. 2B.
Figure 4:
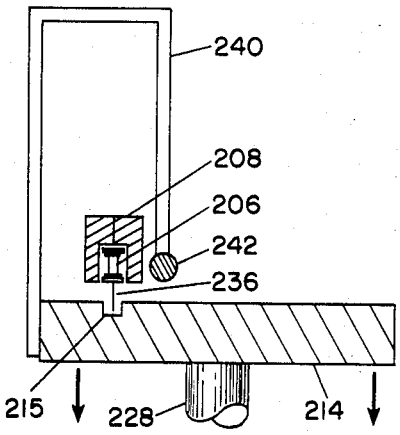
FIG. 4 is a fragmentary cross-sectional view taken along line 4—4 in FIG. 3 of the pin chain and its supporting structure used in the sewing and unload/stacker portions of the apparatus.

As shown in FIGS. 1 and 2B, chain support structure 198 is mounted above the fully raised position of front section 158 of third platform 145. Structure 198 is supported by vertical support members, such as member 196 attached to frame member 42, and others not shown. Chain support 198 is provided with sprockets 200, 202 and 204 located as shown in FIG. 2B to which is mounted pin chain 206. Structure 198 also supports a chain guide member 208 through which chain 206 passes on its route from the periphery of sprocket 200 to the periphery of sprocket 204 as illustrated in the top view of FIG. 2B. Pin chain 206 is powered by a stepper motor 372, which drives sprocket 204, as shown in FIG. 3.

Figure 17:
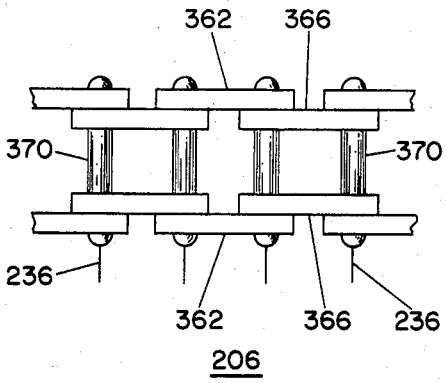
FIG. 17 is a fragmentary side elevational view of the pin chain used in the FIG. 1 apparatus.

FIG. 17 is a detailed illustration of a typical portion of chain 206. As shown in FIG. 17, chain 206 includes outer connecting segments 362 and inner connecting segments 366 joined by connecting pins 370 to form links. Chain 206 as thus far described is of standard manufacture, such as a one-quarter inch number 25 chain, and is preferably made of a fiberglass reinforced nylon material such as Mylatron, which has a self-lubricating characteristic.

Connecting pins 370 of a standard chain as described above are axially bored and then press fit with pins 236. Pins 236 are sized to project from the connecting pins 370 by a distance sufficient to engage the material to be transported and maintain the engaged portions of the material in a predetermined relationship or alignment during transport. In the case of commonly used knit fabric for children's shirts, this distance preferably is approximately 0.15 inches.

In the illustrated embodiment of the present invention, chain 206 is a continuous chain and is supported by sprockets 200, 202 and 204 and is run through and is carried by chain guide 208 as it passes the operating parts of sewing portion 34 and unload portion 36 of apparatus 30, namely platform section 158, sewing machine 210 and sewing platform 212, and unload platform 214.

An optical material edge detector 216, which may be a Scan-a-matic Model No. TS322-2, is provided adjacent sewing machine 210. Also shown in the top view of FIG. 2B are stacking members 218 and 220. A cover plate 192, which is not illustrated in the top view of FIG. 2B, may be provided to cover the support frame 188, rods 178, 180 and cylinder 194.

FIG. 3 is a partial side elevational view of the unload/stacking portion 36 and the sewing part of sewing portion 34. Illustrated in FIG. 3 are sewing machine 210, optical edge detector 216, chain guide 208, sewing platform 212 and unload platform 214. It can be seen in FIG. 3 that pins 236 of the chain 206 extend from chain guide 208 toward platforms 212 and 214. As illustrated in the cross-sectional view of FIG. 4, the platforms 212 and 214 are respectively provided with longitudinal grooves 213 and 215 that are preferably of U-shaped cross-section into which the ends of pins 236 of chain 206 project. Referring to FIG. 2B, the path of the chain 206 includes the obtuse V-shaped path along groove 159 in platform section 158 as well as straight grooves 213 and 215 provided in support platforms 212 and 214 that are hidden from view by chain guide 208.

Unload platform 214 is movable between a raised position illustrated in FIG. 3 and a lowered position wherein pins 236 no longer project into the groove 215. This movement is under the operation of cylinder 234 which has its cylinder rod 232 connected to platform bracket 230 that supports platform 214. Platform 214 moves up and down guided by rods 226 and 228 which pass through bores in support frame 224. A cover plate 222 is mounted to support frame 224 and horizontal frame member 58. This separates the material from the operating portions of the machine and keeps the material from becoming soiled thereby. As illustrated in the cross-sectional view of FIG. 4, platform 214 is also provided with support brackets 238 and 240 which support a rod 242 that extends parallel to and adjacent the path of chain 206 in chain guide 208. When support platform 214 moves to its lowered position under the influence of cylinder 234, rod 242 attached thereto is simultaneously lowered and serves to press the fabric away from pins 236 and thereby releases the fabric from engagement with chain 206.

Figure 5:
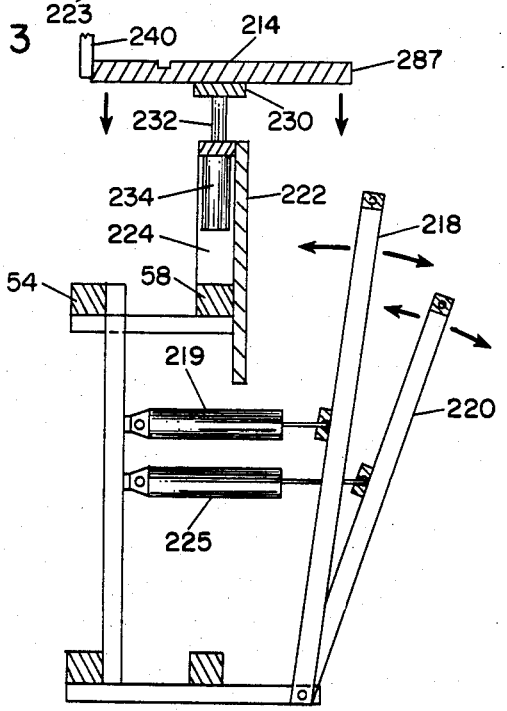
FIG. 5 is a fragmentary side elevational view taken along line 5—5 of FIG. 3 illustrating the unload/stacker portion of the apparatus.

The automatic stacking of sewn fabric pieces is accomplished via the interaction of chain 206, platform 214, upper stacking hanger 218, and lower stacking hanger 220, in a manner which will be described in conjunction with the operation of the machine. As shown in FIGS. 3 and 5, hangers 218 and 220 each have an inverted U-shape formed by two generally vertical side pieces and a crossbar, and each pivots about pivot means 223. The positions of hangers 218 and 220 are respectively controlled by air cylinders 219 and 225 attached to the hangers as shown in FIG. 5. Hangers 218 and 220, which are sometimes called stackers, are each pivotable between a first or outer position wherein the crossbar of the hanger is substantially spaced away from shield 222 and the sides of each hanger are inclined away from the vertical and a second or inner position wherein the sides of each hanger are substantially vertical and the crossbar of each hanger is disposed under platform 214.

Figure 21A:
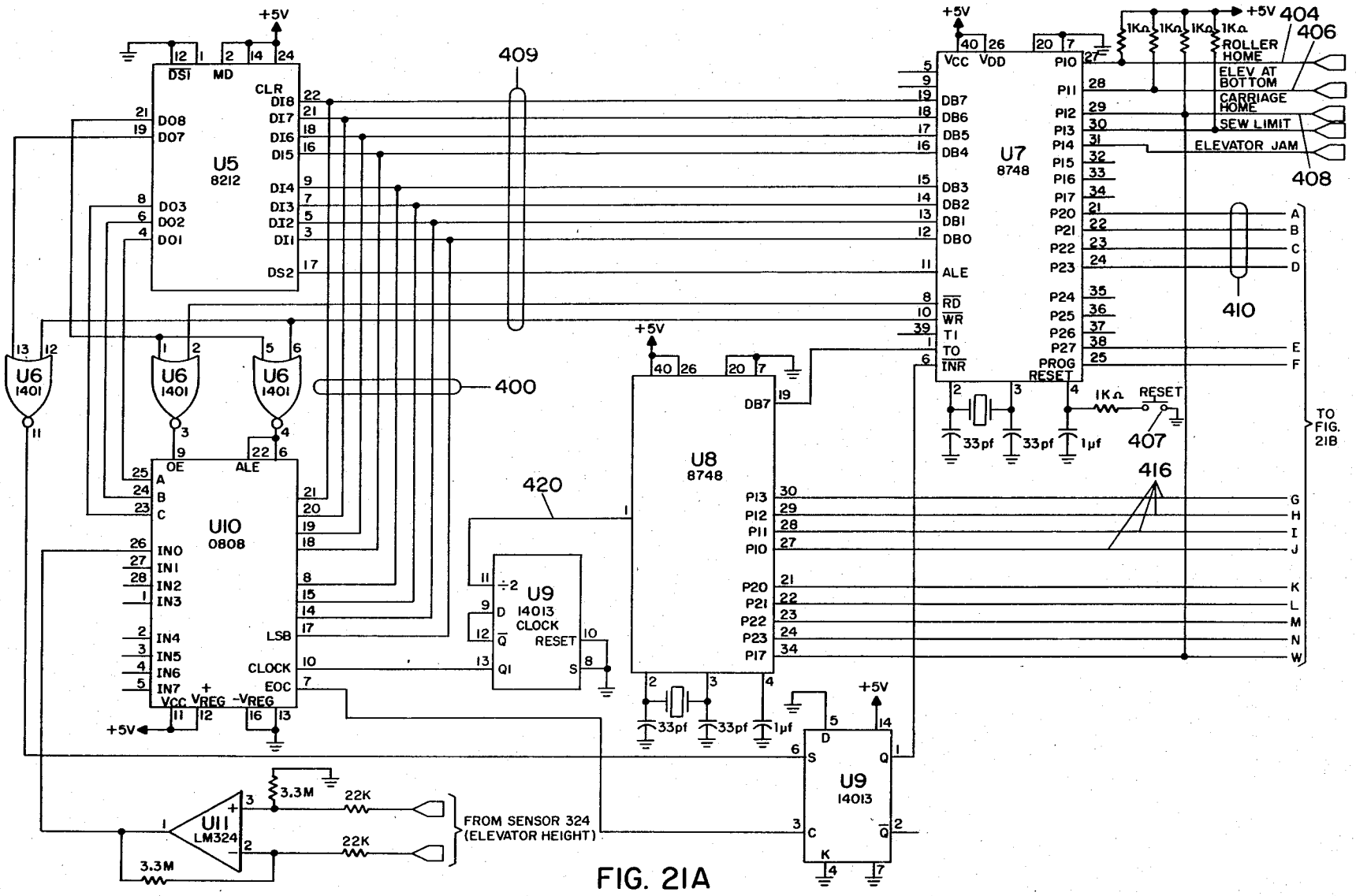
FIGS. 21A through 21C form an electrical schematic of a microcomputer control circuit for operating the FIG. 1 apparatus.
Figure 21B:
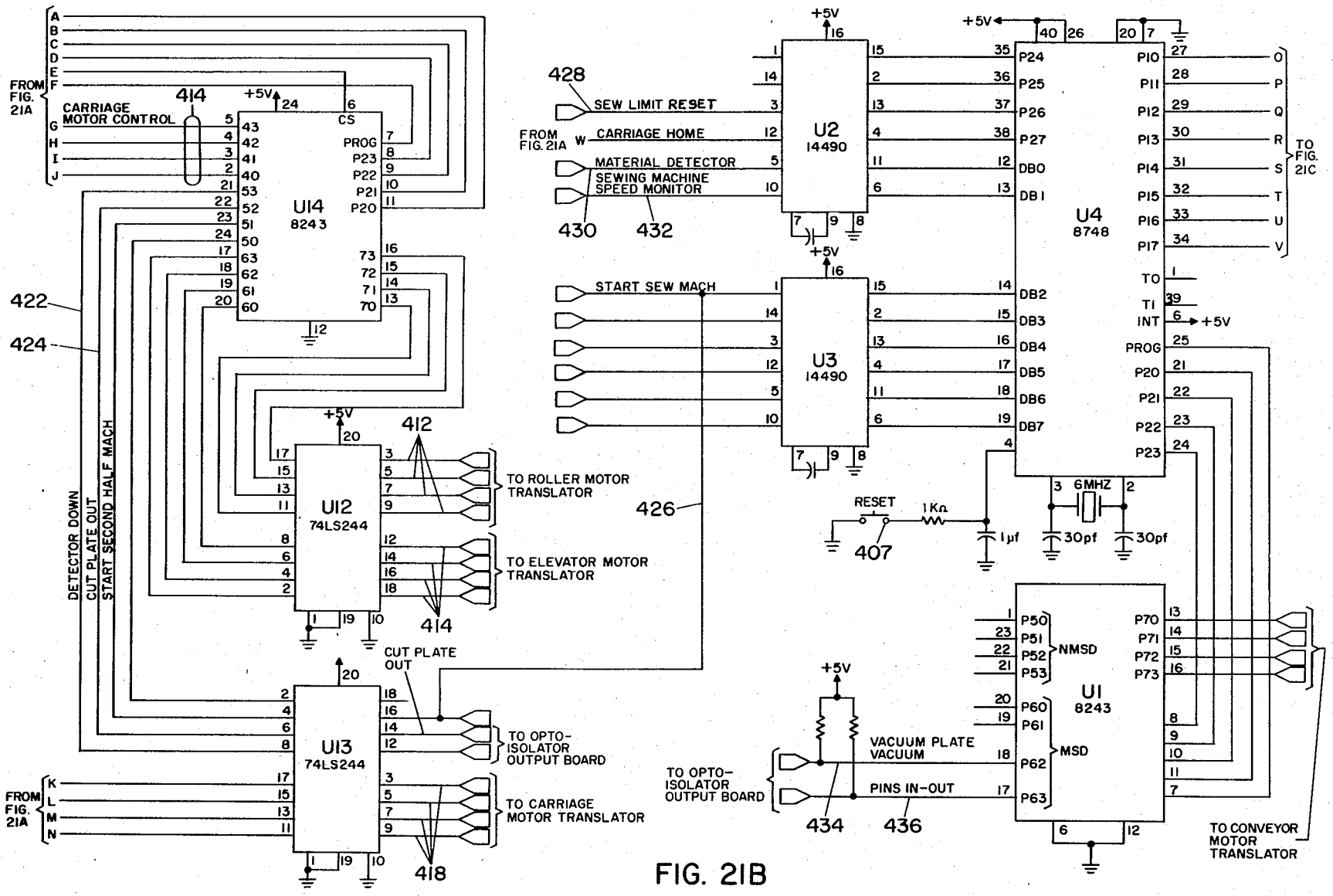

FIG. 21 is a schematic diagram of a microprocessor-based control circuit that represents the heart of controller 74, which controls the operation of the FIG. 1 apparatus. As will be readily appreciated by those skilled in the art, controller 74 also includes a number of conventional devices (not shown) such as a D.C. power supply and opto-isolator output board containing triacs and/or other similar power switching devices for energizing other conventional electrical devices such as a motor contactor to energize the blower that creates the vacuum utilized by platform section 158. Also included in controller 74 are conventional translators for driving conventional stepper motors utilized in apparatus 30. For example, a Model No. DRD003 translator available from Superior Electric Company of Bristol, Conn. may be used to operate a stepper motor made by the same company which is used as carriage drive motor 147 in apparatus 30. The model number of specific integrated circuit components as well as the values of several discrete components such as capacitors and resistors are provided in FIG. 21. The control circuit of FIG. 21 includes three microcomputers U4, U7 and U8, which include the control programs set forth in the microfiche appendix in this application. Microcomputers U7 and U8 acting in concert largely control the positioning portion 32 of apparatus 30, while microcoputer U4 largely controls the sewing portion 34 and the unload/-stacker portion 36 of apparatus 30.

The input signals provided to microcomputer U7 are provided from several sources. First, there is an eight bit digital word or signal 400 derived from the analog signal produced by magnetic sensor 324. Op amp U11 conditions the analog signal from sensor 324 before it is converted to a digital value by A-to-D converter U10. Discrete digital signals from conventional Hall IC sensor devices such as Microswitch Model No. 103SR5A-1 or conventional limits such as Grayhill Model No. 4002 or Microswitch Model No. BZ-2RW863-AZ, which are mounted as required on apparatus 30, are also provided to microcomputer U7. Such digital signals include signal 404 indicating roller 332 is in its home position, signal 406 indicating the first or elevator platform 76 is at its lowest position, and signal 408 indicating carriage 130 is at its home position near the rear end of carriage frame 65. Reset buttons 407 may be provided to reset all three microcomputers.

Control signals internal to the operation of the FIG. 21 circuit are provided by microcomputer U7 through its data bus 409 and eight bit I/O port U5. Output signals 410 from microcomputer U7 for controlling external devices are multiplexed through port expander U14. These output signals include the stepping signals 412 and 414 conditioned by output buffer U12 which drive the translators for stepping motors 124 and 340 used for adjusting the height of elevator platform 76 and rotating roller 332 respectively. Also multiplexed through port expander U14 are command signals 414 from microcomputer U7 to microcomputer U8, which operate largely in a master-slave relationship. Microcomputer U8 is principally dedicated to furnishing the stepping signals 418, conditioned by output buffer U13, that drive carriage motor 147. It also provides a timing signal 420 used to control when the A-to-D converter U10 is sampled. The two flip-flops on IC chip U9 are utilized in conjunction with the sampling of data values from converter U10.

Other output signals from microcomputer U7 multiplexed through expander U14 include air valve control signals 422 and 424 for respectively operating air cylinder 312 to lower and raise sensor body 308 of stack level sensing mechanism 99 and air cylinder 194 to advance and retract the cut plate, which is platform section 158. A "start sewing machine" signal 426 is also provided through expander U14 to instruct microcomputer U4 when it may begin operating sewing portion 34.

Microcomputer U4 receives input signals through input buffers U2 and U3, such as signal 428 from the reset sew limit, signal 430 from optical fabric edge detector 216, and signal 432 from magnetic sensor 378 which monitors the rotating magnet 376 on sewing machine shaft 374. Inputs may also be provided to microcomputer U4 through port expander U1 if desired, as is done via input signals 434 and 436. Stepping signals for driving the stepper motor 372 associated with pin chain 206 are also relayed through port expander U1.

Figure 21C:
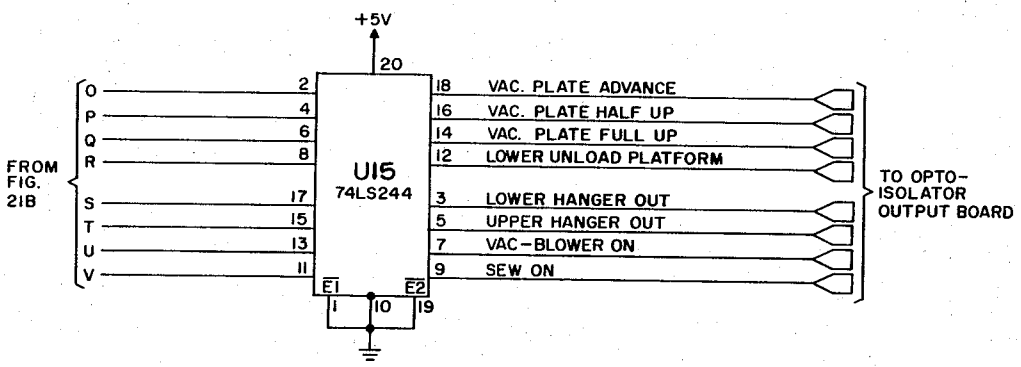

Output buffer U15 shown in FIG. 21C conditions a number of output signals to control various solenoid-operated air valves, including those operating cylinders 272, 274 and 194 associated with the vacuum plate, i.e., platform section 158, and those operating stacker cylinders 219 and 225 and unload platform cylinder 234. Other output signals relayed by output buffer U15 include signals to command sewing machine 210 to run and to turn on the blower, thus providing vacuum for vacuum plate 158.

Figure 18:
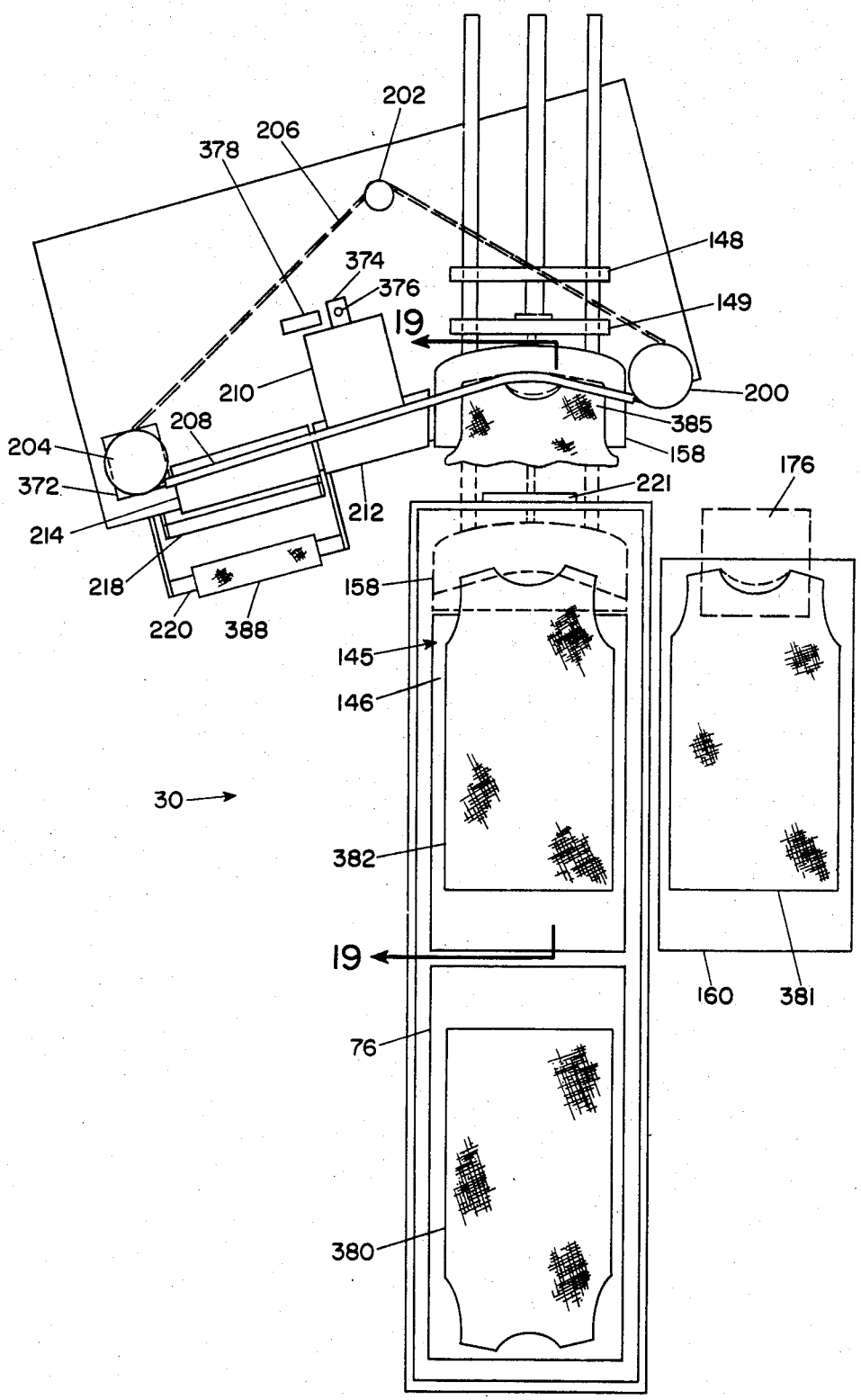
FIG. 18 is a simplified top view of the FIG. 1 apparatus for the purposes of illustrating its operation.

The operation of the invention will now be described in detail by reference primarily to FIGS. 18, 19 and 20. The embodiment of the present invention which has thus far been described is particularly useful in connection with the automatic sewing of a shoulder seam on a garment, such as a T-shirt. The machine 30 starts its operation using a stack 380 of fabric plies, which has been placed on platform 76 as shown in FIG. 18. The stack 380 of fabric plies is cut from a stack of tubular knit fabric as has been previously described, so that alternate plies in the stack are arranged to form the front and back of a T-shirt. Top ply 381 in the stack 380 will form the front of a T-shirt, and is arranged in stack 380 with its outer surface facing upward. Second ply 382 in stack 380 will form the back of a T-shirt and is arranged in the stack with its outer surface facing downward. Each subsequent adjacent pair of layers in stack 380 is arranged in an identical fashion, and will form the front and back of a T-shirt.

Each pair in stack 380 is thus arranged with the inner surface of the front and back plies facing one another. In order to join each pair of plies at the shoulder seam in a proper sewing arrangement, that is so the shoulder seam will later be hidden, it is necessary to have the pairs of plies reoriented from their aforementioned orientation in stack 380 to an arrangement wherein the outside surfaces of the pair of plies to be sewn together faces each other. Also, the pair of plies must be mated, that is properly aligned with respect to one another in the area that will form the shoulder seam. These orientation and mating operations are both achieved using the positioning portion 32 of the apparatus 34 which is illustrated overall in FIG. 2A.

After initial placement of stack 380 on platform 76, the first operation is the adjustment of the height of platform 76 using motor 124. The height is adjusted so that roller 332, which is carried by carriage 130 (not illustrated in FIG. 18), can engage the top ply of fabric on the stack 380. This adjustment is achieved using the microprocessor based controller 74 which operates motor 124 in conjunction with the operation of stack level sensing apparatus 99 illustrated in FIG. 13. At the commencement of the adjustment, motor 124 is provided with stepping signals from controller 74 while cylinder 312 is operated to position engagement pad 322 in its lowermost position with respect to horizontal support 304. As platform 76 is raised, the top ply of fabric engages pad 322 and causes upward motion of magnet 320 toward magnetic field sensor 324. The output of sensor 324 is provided to an analog-to-digital converter those output is then compared to a threshold signal. When the output from sensor 324 equals the threshold signal, platform 76 is located at the appropriate vertical position, and controller 74 discontinues the supply of stepping signals to motor 124. At this point, cylinder 312 is operated to draw pad 322 out of engagement with the top ply of fabric stacker 380, and sensor body 308 and pad 322 out of the path of carriage 130.

Figure 20A:
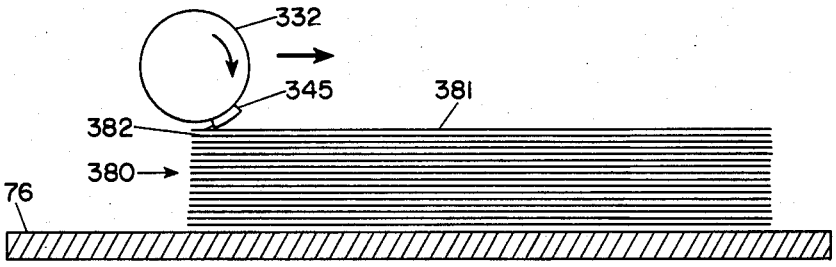
FIGS. 20A through 20H are a set of simplified side views of the roller and fabric engaging mechanism on the carriage for the purpose of illustrating the operation of the FIG. 1 apparatus.
Figure 20B:
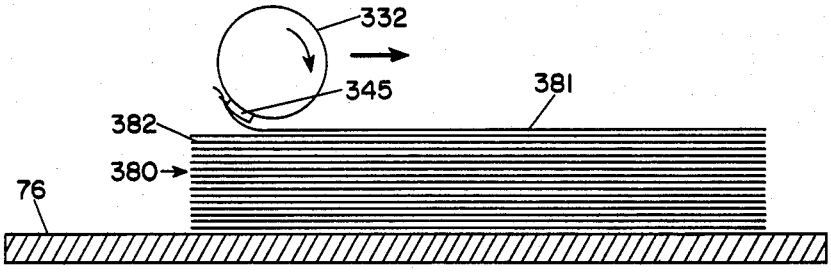
Figure 20C:
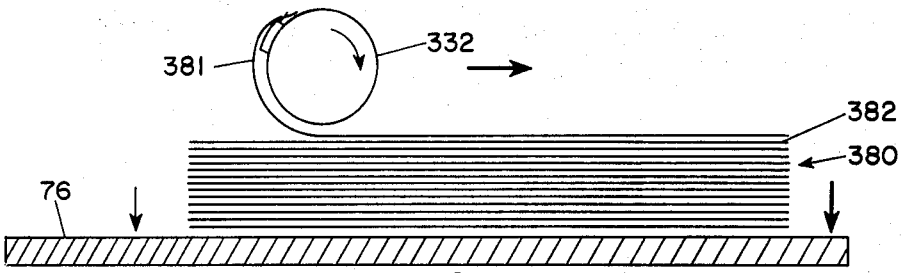
Figure 20D:
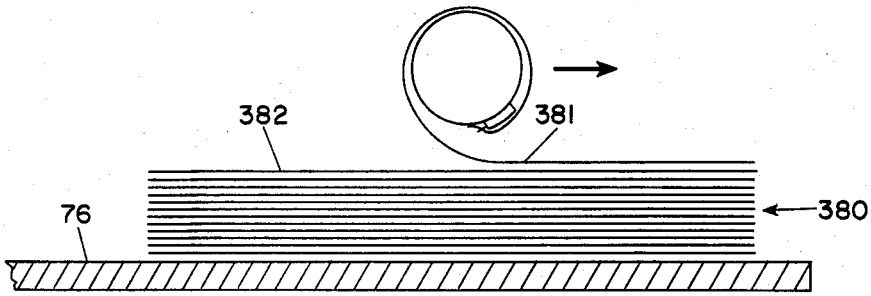

Controller 74 next provides signals to operate stepper motor 147 so as to position carriage 130 at an initial position toward the rear end of positioning portion 32 of apparatus 30 (i.e., the far left side of FIG. 1 and the bottom of FIG. 18). The "home" position of roller 332, which is carried by carriage 130, at the start of this operation is illustrated in FIG. 20A. As can be seen in FIG. 20A, the previous operation has positioned top ply 381 of fabric stack 380 at an appropriate height to be engaged by the engaging mechanism 345 carried by roller 332. After the initial positioning of carriage 130, stepper motor 147, which moves carriage 130, and stepper motor 340, which is carried by carriage 130, are operated simultaneously and in coordination by controller 74 so that, carriage 130 is moved forward (to the right as viewed in FIGS. 20A and 20B) while- roller 332 is rotated clockwise to provide a controlled engagement between the roller and top ply 381 of fabric stack 380. Specifically, the outer surface of roller 332 preferably has an angular velocity that matches the linear velocity of carriage 130 so as to result in a rolling engagement with top ply 381. Since the pin engagement mechanism 345 has a larger radius 332 than the surface of roller 332, it moves at a faster linear velocity than the outer surface of roller 332. Accordingly, pins 348 projecting from engaging mechanism 345 have a slightly backward motion with respect to top ply 381 during the engagement process and will engage the top ply as illustrated in FIG. 20B.

Figure 20E:
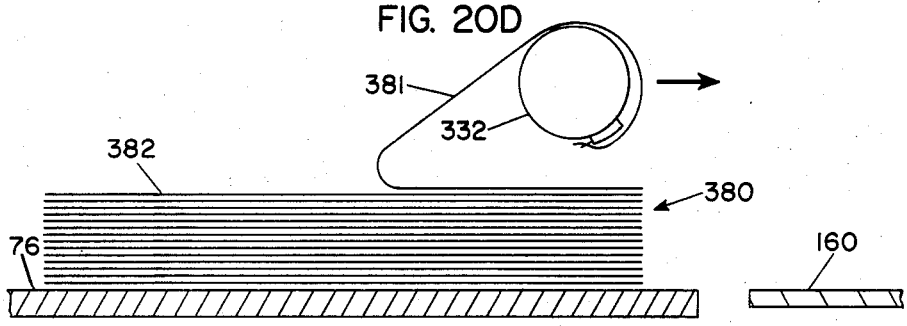
Figure 20F:
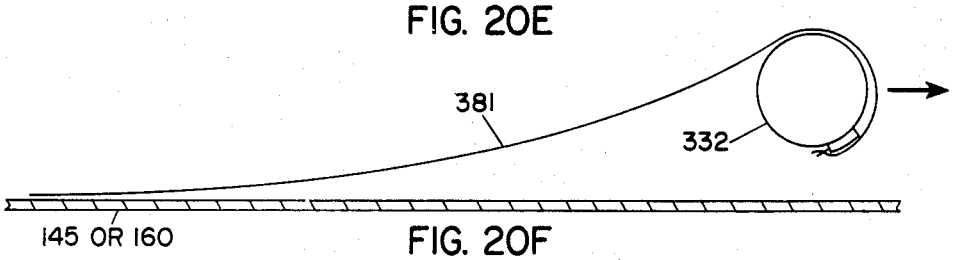
Figure 20G:
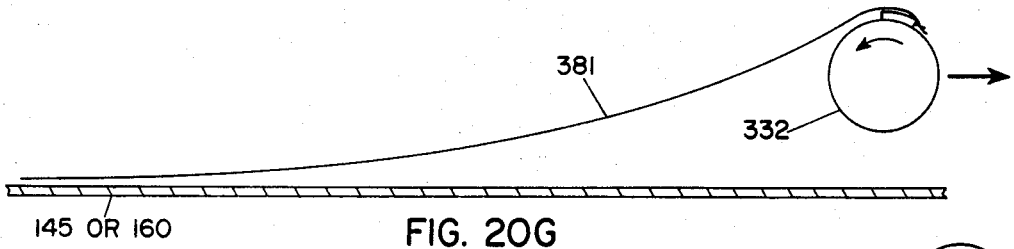
Figure 20H:
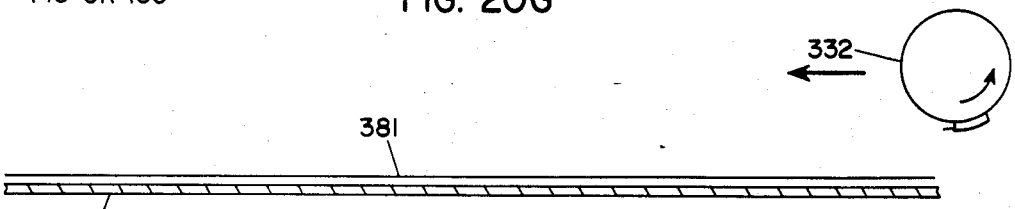

The foregoing coordinated motion of carriage 130 and roller 332 is continued in order to wrap the top ply 381 around roller 332. During the continuance of this motion, stepper motor 124 is operated in a reverse direction to lower platform 76 approximately a quarter inch (illustrated in an exaggerated fashion in FIGS. 20C and 20D) so that roller 332 and engaging mechanism 345 will be spaced apart from the subsequent layers of fabric in stack 380 so as to avoid the possibility of engaging any of them. At the point illustrated in FIG. 20D, where the fabric has been wrapped approximately one revolution around roller 332, the downward motion of table 76 is completed. The rotating motion caused by motor 340 operating roller 332 is then discontinued while the operation of stepper motor 147 to transport carriage 130 forward is continued, and preferably accelerated. This acceleration of carriage 130 causes a rapid peeling away of top ply 381 from stack 380 as illustrated in FIG. 20E. Carriage 130 continues to travel forward toward the front end of positioning portion 32, drawing fabric ply 381 onto platform 160, which is in its first position over platform 145. This is illustrated in FIG. 20F. When the fabric has reached the appropriate location on platform 160, the motor 340 is again operated, this time in the opposite direction, to rotate roller 332 counter-clockwise, and thereby disengage ply 381 onto platform 160 as illustrated in FIG. 20G and 20H. The action of carriage 130 and roller 332 thus far described has removed the top ply 381 from fabric stack 380 and positioned it in a predetermined location on platform 160.

Carriage 130 is then returned to its initial position toward the rear end of positioning portion 32, and platform 76 is raised to a new initial position such that second ply 382 of fabric stack 380 is in a position to be engaged by engaging mechanism 346 of roller 332. The stack level sensing apparatus 99 shown in FIG. 13 is used in a manner previously described to determine the new initial position. As carriage 130 returns to its starting position, platform 160 is moved laterally to its second position, spaced away from platform 145, and illustrated in FIG. 18. Carriage 130 and roller 332 are then again operated as illustrated in FIG. 20 to engage second ply 382 from fabric stack 380 and position it in a predetermined location upon platform 145 as shown in FIG. 18.

The process of putting first ply 381 on platform 160 and second ply 382 on platform 145 through the peeling action illustrated in FIG. 20 reverses the orientation of each ply so that the surface of each ply previously facing upward is now facing downward. Accordingly, as may be understood by reference to FIG. 18, first ply 381 has been oriented on platform 160 with its outside surface facing downward, and second ply 382 has been oriented on platform 145 with the outer surface of the fabric facing upward.

When platform 160 reaches its second position, an optional neckline cutting apparatus 176 may be operated as appropriate to modify the neckline of the first ply 381 to form the desired front neckline of a shirt. Following this cutting operation (if provided) and the placement of second ply 382 upon platform 145, platform 160 is returned to its first position directly above platform 145 so that fabric ply 381 is above fabric ply 382. At this point, plies 381 and 382, which have both been placed at predetermined locations, are in proper longitudinal and transverse alignment with respect to one another, but still need to be brought together in a vertical direction to complete the mating operation.

Figure 19A:
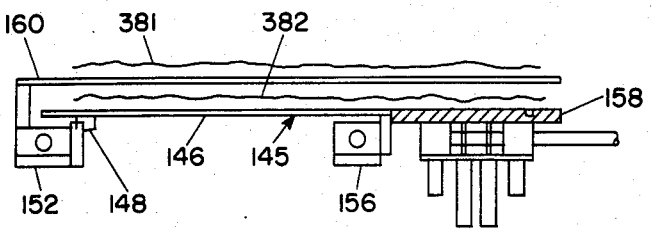
FIGS. 19A, 19B and 19C are three simplified cross-sectional views of the second and third platform areas of the positioning portion of the FIG. 1 apparatus for illustrating operation.
Figure 19B:
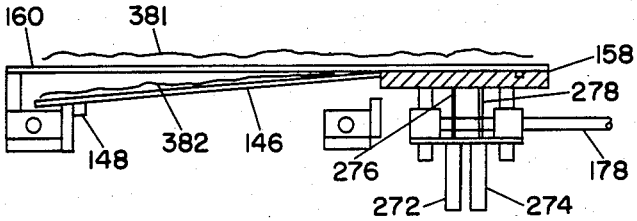

FIG. 19 illustrates the operation of positioning portion 32 of apparatus 30 of the present invention completing the mating of fabric plies 381 and 382, including their transport while mated to sewing portion 34. FIG. 19A shows platforms 160 and 145 in their first positions one above the other with their respective fabric plies 381 and 382 positioned thereon. To assure that fabric ply 382 remains properly positioned relative to section 158, the vacuum source for section 158 is turned on to draw and hold fabric 382 snugly against section 158. As illustrated in FIG. 19B, section 158 of platform 145 is then operated to move in an upward direction as illustrated in FIG. 19B from its first or fully lowered position to its second or middle position. Section 146 is pivoted at hinges 148, and so this operation carries the front edge of section 146 that rests on transverse notch 146 of section 158 upward. This operation also places the fabric plies together so they are separated only by the front end of platform 160, which has supporting prongs 298 as illustrated in FIG. 11. At this intermediate position, the vacuum suction on platform section 158 also draws fabric 381 to fabric 382 through air drawn past prongs 298 in the cut-out area 296 of platform 160. Because fabric plies 381 and 382 were positioned at predetermined locations on platforms 160 and 145 respectively, these two plies have at this point also been mated or properly aligned for the shoulder seam sewing operation that follows.

Figure 9:
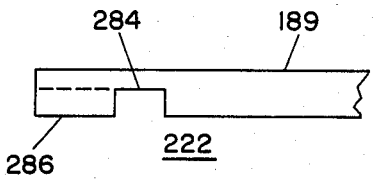
FIG. 9 is a fragmentary top view of the end guiding member shown in FIG. 8.
Figure 8:
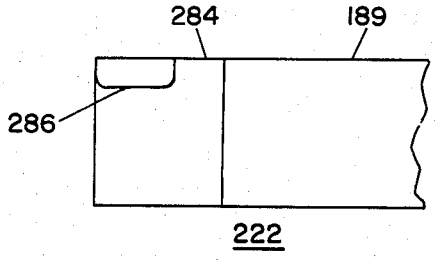
FIG. 8 is a fragmentary side view of an end guiding member which is engaged by the front section of the third platform of the present invention.
Figure 19C:
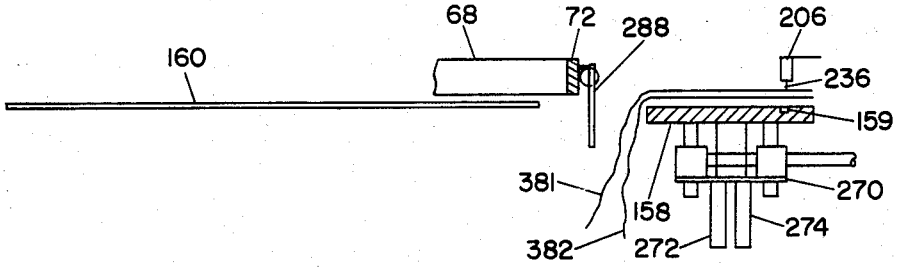

With the vacuum suction still turned on, platform section 158 is then advanced (that is moved to the right when viewed in FIG. 19C), to its second or advanced position directly below the pin chain 206 carried by chain guide 208. This motion begins to draw or does draw fabric ply 382 off of rear section 146 of platform 145 and fabric ply 381 off of platform 160. Lever arm 288 of fabric pull-off mechanism 221 on frame member 72 is operated to complete the pulling off of the fabric from second platform 160 and third platform section 146, as illustrated in FIG. 19C. When platform section 158 has reached its advanced position, cylinder 274 is operated to raise section 158 to its fully raised position wherein chain pins 236 extend into groove 159 of section 158, which also causes pins 236 to project through plies 381 and 382 directly adjacent to where the shoulder seam is to be sewn. During this final positioning of platform section 158, as is illustrated in FIGS. 8 and 9 projection 282 on support member 280 carried by platform section 158 is engaged in guiding channel 284.

Following the engagement by pins 236 of fabric plies 381 and 382 as described with respect to FIG. 19C, these two fabric plies are in the position 384 illustrated in FIG. 18, and fully prepared for the sewing operation. Those skilled in the art will appreciate that the portions of fabric plies 381 and 382 in the vicinity of pins 236 are held and will continue to be held in proper alignment with respect to one another so long as pins 236 remain entrenched in the plies, even when chain 206 is transported along chain guide 208. Fabric plies 381 and 382 thus engaged by pins 206 will henceforth be called fabric 385 for convenience.

At this point controller 74 causes the operation of stepper motor 372, sometimes called the conveyor motor, to transport the fabric 385 toward sewing machine 210. As fabric 385 approaches sewing machine 210, edge detector 216 senses the leading edge of fabric 385, which initiates the operation of sewing machine 210. At the same time, continued operation of stepper motor 372 positions the leading edge of fabric 385 at the sewing position of sewing machine 210. Once this position is reached, the operation of stepper motor 372 is coordinated with the operation of sewing machine 210 by controller 74. To accomplish this coordination, timing signals are derived from pulses generated by magnetic field sensor 378, which detects the passing of magnet 376 on now rotating sewing machine shaft 374. This enables the movement of chain 206, and hence the rate at which fabric 385 passes across the sewing machine position, to be synchronized with the operating speed of sewing machine 210 during the sewing process. When the trailing edge of fabric 385 is detected by edge detector 216, the synchronized control of stepper motor 372 is continued for a predetermined number of pulses to permit the sewing of the trailing edge of fabric 385 before discontinuing synchronization.

After the trailing edge of fabric 385 has passed the sewing position, chain 206 is momentarily stopped to allow a venturi edge trimmer provided with sewing machine 210 to draw the trailing edge of the sewing thread into a cutter to sever the sewing thread dangling from sewing machine 210 to fabric 385.

The operation of the unload and stacker portion 36 of apparatus 30 may now be described with reference to FIGS. 3, 5 and 18. Prior to the time that fabric plies 385 are transported to unload platform 214, the stacker portion 36 is or will be immediately placed in the following initial state: platform 214 is in its raised position, and upper hanger 218 and lower hanger 220 are each in their returned position, i.e., which means the crossbar of upper hanger 218 is beneath platform 214 while the crossbar of lower hanger 220 is spaced substantially away from platform 214. Once this initial state is achieved, and after the sewing operation has been completed, chain 206 is operated to transport fabric plies 385 to unload platform 214 at which point chain 206 is stopped. The ends of fabric plies 385 opposite the sewn shoulder seam at this point drape down over the rear edge 287 of platform 214 and extend behind and well below the crossbar of upper hanger 218. Lower hanger 220 is then moved to its second or advanced position where its crossbar contacts and remains in front of the part of fabric 385 draping down in front of hanger 218. Next, platform 214 is moved to its lowered position, which carries rod 242 downward so as to disengage fabric 385 from pins 236 of chain 206. Once uncoupled from chain 206, the upper half of fabric 385 is swung over the crossbar of lower hanger 220 by the movement of upper hanger 218 to its first or advanced position.

Accordingly, fabric 385 is now hung from the crossbar of lower hanger 220, draping down over the front and back sides of the crossbar. At this point, in preparation for the next unloading operation, upper hanger 218, upper hanger 220 and unload platform 214 are each moved to their respective returned position. Further cycles of apparatus 30 will cause a pile of sewn fabrics, identified as 388 in FIG. 18, to accumulate on the crossbar of lower hanger 220, where they may be periodically removed by an operator.

Although chain 206 described hereinabove represents the preferred embodiment of the pin chain aspect of the present invention, those skilled in the art should appreciate that chain 206 is in a larger sense a transport means for engaging and conveying fabric while maintaining the engaged portions or segments of the fabric in predetermined alignment. In its broadest form, such transport means would minimally include the following two elements: (1) a flexible elongated carrier movable along a two-dimensional curved path, said path defining a plane; and (2) at least several pins for engaging fabric mounted on and along at least part of the carrier substantially within the width of the carrier, said pins being spaced apart from each other and projecting from the carrier in a direction perpendicular to both said plane and said curved path. Flexible elongated carriers movable along a two-dimensional curved path would thus include not only chains, but also belts, pulleys, straps and strips made of any suitable or conventional material including but not limited to metals, plastics, fiber-reinforced polymers, and rubber or rubber compounds. Also, the flexible elongated carriers need not be made in closed loop form either, since a length of such carrier may be reciprocated back and forth along a curved path while supported by a suitable carrier guide, rather than circulated around sprockets or pulleys in an endless loop. Further, the mounting of the projecting pins on the flexible carrier need not be confined to drilling suitable bores into the carrier as is done to the chain shown in the preferred embodiment. For example, the projecting pins could be molded or otherwise fastened into suitable holders and the holders then embedded or otherwise captivated in a belt or chain having recesses, pockets, bores, or other clamping means suitably designed to receive such pin holders. Also, the width of the carrier, as that term is used above, is to be understood to mean the thickness of the widest cross-section of the carrier taken in the plane of the curved path, not including any increase in thickness due to pin holders (if used). Those skilled in the art should also appreciate that the projecting pins need not project from every possible mounting spot or point on the carrier, but only need project from at least some of the mounting spots, that is, enough to properly engage the fabric as is required to properly sew the seam or otherwise maintain the desired alignment of the fabric pieces through or into which the projecting pins project. Further, if it is known that certain parts of the carrier will never engage the fabric or like material to be sewn or transported, then those parts of the carrier need not be provided with projecting pins.

Those skilled in the art should also appreciate that, depending upon the type of mounting selected for the projecting pins, the pins may be free to swivel about their own individual axes while otherwise remaining perpendicular to the plane of the curved path. Finally, even though such a transport means has been defined above by reference to a curved path of two dimensions, it is to be appreciated that through the use of a suitably long and flexible carrier, supported if necessary by a suitably shaped carrier guide, the transport means could be used to engage and transport fabric while maintaining the desired fabric alignment along a three-dimensional curved path.

One important advantage of the present invention is the ability of sewing portion to sew a curved seam. In the illustrative embodiment, the geometry of the curved seam to be sewn corresponds to the geometry of groove 59 on platform section 148. It is to be appreciated that the transport and sewing of fabric plies 381 and 382 by chain 206 has been simplified by sewing the desired curved seam on a straight line corresponding to groove 213 on sewing platform 212. The ability of the disclosed apparatus of the present invention to sew a curved seam is created by the ability of chain 206 to negotiate curves while projecting pins 236 engaged in fabric plies 381 and 382 maintain the desired alignment between the parts of the fabric plies in the vicinity of the engaged pins, even as other parts of the plies are compressed, wrinkled, twisted or otherwise misaligned as the fabric plies are being transported by chain 206.

In the alternative embodiment of the present invention, a flexible elongated carrier, provided with projecting pins and guided if necessary by an appropriately shaped carrier guide and/or groove, may be used to sew the transported material on a curved line rather than a straight line.

The curved seam to be sewn may have any number of distinct segments, and these segments may be individually sewn by automatically cutting the sewing thread in between the segments. In this regard, it is to be recognized that the shoulder seam of the T-shirt sewn by the illustrative embodiment herein described has two distinct segments, one on either side of the neckline. Further, the present invention contemplates that the overall geometry of the seam may curve considerably and in several directions along a continuous path so long as the fabric engaging and transport means is varied to suit the new geometry. Thus, it should be appreciated that the present invention may be used to sew a much more complex than the simple curve present in the shoulder seam of a T-shirt, and it may also be used to sew straight seams.

While there has been described what is believed to be the preferred embodiment of the present invention, those skilled in the art will recognize that other changes and modifications may be made thereto without departing from the spirit of the invention, and it is intended to claim all such changes as fall within the true scope of the present invention.

I claim:

1. Apparatus for transporting fabric or similar material in a selected curved path along a surface, comprising:

an endless flexible conveying member comprising a chain having a plurality of transversely extending pins;

a curved groove on said surface along at least a curved portion of said path receiving the ends of said pins;

means for supporting said conveying member adjacent said surface along said path with said pins extending into said groove;

and means for transporting said conveying member along said path.

2. Apparatus as specified in claim 1 wherein said transporting means include a stepper motor connected to a rotary member engaging said conveying member.

3. Apparatus as specified in claim 1 wherein there is provided a track for guiding said conveying member along said path.

4. Apparatus as specified in claim 3 wherein at least a portion of said track extends along said curved portion of said path.

5. Apparatus as specified in claim 1 wherein at least a portion of said surface and said groove are moveable with respect to said chain and said pins to engage and disengage fabric on said surface portion.

6. Apparatus for transporting fabric or similar material along a selected path, comprising:

a supporting surface comprising first and second surface portions and having a groove extending across said surface portions and defining said path, said first surface portion being movable in a first direction substantially perpendicular to said surface; and a transport mechanism comprising a flexible elongated carrier having a plurality of transversely extending pins arranged substantially perpendicular to said surface and extending into at least a portion of said groove, and means for supporting and transporting said carrier longitudinally along said path.

7. Apparatus as specified in claim 6 wherein said first surface portion is further movable in a second direction substantially parallel to said surface, thereby to position fabric on the portion of said path defined by the portion of said groove on said first surface portion.

8. Apparatus as specified in claim 7 wherein said first surface portion includes fabric engaging means for holding said fabric during said positioning.

9. Apparatus as specified in claim 8 wherein said fabric engaging means comprises vacuum apertures on said first surface portion and means for drawing air through said apertures.

10. Apparatus as specified in claim 6 wherein at least a portion of said groove is curved.

11. Apparatus as specified in claim 10 wherein said curved portion of said groove comprises the portion on said first surface portion.

12. Apparatus as specified in claim 10 wherein said carrier supporting mechanism includes a carrier supporting track having a curve corresponding to the curve of said groove.

13. Apparatus as specified in claim 6 wherein said surface includes a third surface portion wherein said groove extends across said third surface portion, and wherein said third surface portion is movable in a direction perpendicular to said surface.

14. Apparatus as specified in claim 13 wherein said third surface portion includes fabric disengaging means, carried by said third surface portion in said perpendicular direction, to disengage said fabric from said pins.

15. Apparatus for sewing a seam on at least one ply of fabric along a selected seam track on said fabric, comprising:

a supporting surface having an elongated groove defining a path, said groove including a first segment in the form of said seam track;

a sewing machine having a sewing platform forming a portion of said supporting surface, said groove having a second segment extending across said sewing platform;

and a transport mechanism comprising a chain having a plurality of transversely extending pins arranged substantially perpendicular to said surface and extending into at least a portion of said groove, including the groove portion on said sewing platform and means for supporting and transporting said chain longitudinally along said path;

said surface and said transport mechanism being arranged to enable said pins to engage fabric along said first groove segment and transport said fabric along said second groove segment past said sewing machine to sew said fabric along said seam track.

16. Apparatus as specified in claim 15 wherein said supporting surface includes first and second surface portions having said first groove and second groove segments, respectively, and wherein at least said first surface portion is moveable with respect to said chain transport mechanism to cause said pins to engage said fabric along said first groove segment.

17. Apparatus as specified in claim 15 wherein said first groove segment and said seam track are curved and wherein said second groove segment is straight.

18. Apparatus as specified in claim 15 further comprising control means for operating said sewing machine and said transport mechanism.

19. Apparatus as specified in claim 18 wherein said control means includes a sensor coupled to said sewing machine for deriving signals representative of the speed of said sewing machine and means responsive to said speed signals for operating said chain transport mechanism.

20. Apparatus as specified in claim 19 wherein said control means operates in a first mode to operate said chain transport mechanism in response to said speed signals when said sewing machine is operating and in a second mode to operate said chain transport mechanism independent of said speed signals when said sewing machine is not operating.

21. Apparatus as specified in claim 18 wherein said control means comprises a microprocessor operating under a control program for providing control signals to said sewing machine and said transport mechanism.

22. Apparatus as specified in claim 21 wherein said transport mechanism includes a stepper motor and wherein said control signals includes pulses to said stepper motor.

23. Apparatus as specified in claim 21 wherein said control means further includes a sensor coupled to said sewing machine for deriving signals representative of sewing machine operation.

24. Apparatus as specified in claim 23 wherein said sensor is a magnetic sensor coupled to a shaft of said sewing machine.

25. Apparatus as specified in claim 23 wherein said control means includes a fabric edge detector.

26. Apparatus as specified in claim 25 wherein said microprocessor is programmed to be responsive to signals from said edge detector and said sewing machine operation signals and provide signals to control said sewing machine and said chain transport apparatus, to operate said chain transport apparatus in a first independent mode to transport said chain to a first selected position relative to the chain position wherein said edge detector detects a leading edge of fabric, to opeate said sewing machine and operate said chain transport apparatus in a second, dependent mode in response to said sewing machine operation signals to transport said chain to a second selected position relative to the chain position wherein said edge detector detects a trailing edge of fabric and thereafter to discontinue operation of said sewing machine and operate said chain in a third independent mode.

27. Apparatus as specified in claim 26 wherein said sewing machine is provided with a venturi edge trimmer and wherein said microprocessor is programmed to stop said transport mechanism for a brief time at said second selected position before discontinuing operation of said sewing machine, thereby to cut the thread from said sewing machine in said edge trimmer.

28. Apparatus for mating at least two plies of fabric to be joined together, comprising:

a first receiving platform having an apertured end region;

a second receiving platform arranged below said first platform, said second platform including a second platform portion, below said end region, arranged for vertical motion toward said first platform, said second platform portion including means for engaging fabric plies received thereon;

and means for positioning fabric plies at corresponding positions on said first and second receiving platforms;

whereby said fabric plies can be mated by raising said second platform portion and engaging the ply on said first platform to the ply on said second platform portion by said engaging means.

29. Apparatus as specified in claim 28 wherein said first receiving platformis moveable horizontally between a first position on said second platform and a second position away from said platform.

30. Apparatus as specified in claim 29 wherein said positioning means is arranged to position fabric on said first platform in said first position and on said second platform when said first platform is in said second position.

31. Apparatus as specified in claim 28 wherein said engaging means comprises vacuum apertures on said second platform portion and means for selectively drawing air through said vacuum apertures.

32. Apparatus as specified in claim 28 wherein said second platform portion is further arranged for horizontal motion, thereby to draw fabric plies together from said first and second platforms.

33. Apparatus for removing from a stack of fabric plies the top ply of fabric comprising:

a first horizontal platform for supporting said stack of fabric plies;

a carriage arranged for horizontal movement over said first platform in a longitudinal direction with respect to said platform;

a roller, mounted on and carried by said carriage, said roller having an axis transverse to said longitudinal direction;

fabric engagement means mounted on and carried by said roller for engaging the top ply of fabric from said stack; and operating means, for transporting said carriage and rotating said roller in coordination, to cause said roller to rollingly encounter said top ply and cause said engaging means to engage said top ply and draw said top ply about said roller, and to cause said carriage to peel said engaged top ply of fabric from said stack.

34. Apparatus as specified in claim 33 wherein said fabric engagement means comprises pins protruding from said roller and having circumferentially oriented points spaced from the outer surface of said roller.

35. Apparatus as specified in claim 34 wherein said engagement means comprises radially extended mounting means carried by said roller and wherein said pins extend in a circumferential direction from said mounting means.

36. Apparatus as specified in claim 33 wherein said operating means comprises means for horizontally transporting said carriage, means for rotating said roller and means for controlling and coordinating operation of said transporting means and said rotating means.

37. Apparatus as specified in claim 36 wherein said control means operates in a first mode to rotate said roller and operate said carriage transporting means in coordination to cause said rolling encounter and in a second mode to stop operation of said roller and continue operation of said carriage transporting means to peel said engaged ply.

38. Apparatus as specified in claim 37 wherein said carriage transporting means and said rotating means each comprises a stepper motor, and wherein said control means includes a programmed microprocessor for providing control pulses to said stepper motors.

39. Apparatus as specified in claim 38 wherein said control means further includes a programmable digital timer coupled to said microprocessor.

40. Apparatus as specified in claim 33 wherein said first horizontal platform is arranged for vertical motion with respect to said carriage.

41. Apparatus as specified in claim 40 wherein said control means controls the vertical position of said first horizontal platform to have a first roller engaging position when said roller encounters said top ply and a second, lower position, with said stack spaced from said roller while said carriage peels said top ply from said stack.

42. Apparatus as specified in claim 41 wherein there is provided means for sensing the level of said top ply in said first position and wherein said control means is responsive to said level sensing means.

43. Apparatus as specified in claim 42 wherein said first horizontal platform includes a stepper motor for providing said vertical motion, wherein said control means comprises a microprocessor and wherein said microprocessor provides pulses to said stepper motor to raise said first platform until said level sensing means provides said microprocessor with an indication that said top ply is in said roller engaging position.

44. Apparatus for adjusting the level of a platform having a stack of plies of sheet like material, comprising:

a motor arranged to raise and lower said platform;

a level sensor having a vertically moveable element and a vertically fixed element, one of said elements having a magnet and the other of said elements having a magnetic field sensor, said moveable element being arranged to engage an upwardly moving stack on said platform and to decrease the spacing between said magnet and said magnetic field sensor in response to upward force applied to said moveable element by said stack;

a threshold circuit coupled to said magnetic field sensor for providing an output signal respositioning a selected magnitude of magnetic field; and a control circuit coupled to said magnetic field sensor and said motor for providing operating signals to said motor to raise said platform until said output signal is received from said threshold circuit.

45. Apparatus as specified in claim 44 wherein said motor comprises a stepper motor and wherein said operating signals comprise pulses.

46. Apparatus as specified in claim 44 wherein said level sensor is mounted on a support structure and moveable with respect to said support structure betwen a first position wherein said moveable element engages said stack and a second position wherein said moveable element is away from said stack.

47. Apparatus for removing and positioning single plies of fabric from a stack of fabric plies, comprising:

a support frame having transverse and longitudinal horiziontal directions;

a first horizontal platform, said first platform mounted at one longitudinal end of said frame and arranged for vertical movement with respect to said frame for holding said stack;

platform transport means for adjusting the vertical position of said first platform;

a second horizontal platform mounted at the other longitudinal end of said frame for receiving said ply;

a carriage arranged for longitudinal, horizontal motion with respect to said frame;

carriage transport means for causing said carriage motion;

a horizontal roller, mounted on said carriage with a roller axis in said transverse direction, said roller having fabric engaging means;

roller driving means, mounted on said carriage for rotating said roller about said axis; and control means for operating said carriage transport means, said roller driving means and said platform transport means in coordination to cause said platform transport means to position said first platform at a vertical position for engagement of said stack by said roller, to cause said carriage transport means and said roller driving means to operate in coordination and cause said roller to rollingly engage said top ply of said stack and roll said top ply about said roller by a selected amount, to cause said roller driving means to stop while said carriage transport means continues to operate and said platform transport means lowers said platform a selected amount, thereby to cause said carriage means to peel said ply from said stack, and to cause said carriage transport means to draw said ply onto said second platform and to cause said roller driving means to drive said roller in a reverse direction to disengage said ply on said second platform at a selected position on said second platform.

48. Apparatus as specified in claim 47 wherein said carriage transport means, said platform transport means and said roller driving means comprise stepper motors, and wherein said control means comprises a programmed microprocessor for operating said stepper motors.

49. Apparatus as specified in claim 47 further comprising means for sensing the level of the top ply of said stack and wherein said control means is responsive to said level sensing means for controlling said platform transport means.

50. Apparatus as specified in claim 47 wherein there is provided a third horizontal platform for receiving said ply, said third platform mounted at said other horizontal end of said frame and arranged for transverse horizontal motion with respect to said frame between a first position over said second platform and under the path of said carriage and a second position away from said second platform, and wherein there is provided a third platform positioning means for moving said third platform between said first and said second positions, and wherein said control means controls said third platform positioning means to cause said third platform to be in said first position and receive a ply from said roller and to be in said second position whereby said second platform receives a ply from said roller.

51. Apparatus for mating at least first and second plies of material to be joined by a seam along seam tracks on said plies, comprising:

means for individually engaging said first and second plies from a stack of similar plies and for positioning said plies at corresponding locations on first and second receiving platforms;

and means for jointly engaging said plies in the vicinity of said seam tracks and for drawing said plies from said platforms while jointly engaged.

52. Apparatus as specified in claim 51 wherein said individual engaging and positioning means includes means for inverting said plies.

53. Apparatus as specified in claim 52 wherein said joint engaging means includes vacuum apertures and means for drawing air through said apertures.

54. Apparatus for mating at least first and second plies of material and sewing said plies along a seam track on said plies comprising:

means for individually engaging said first and second plies from a stack of similar plies and for positioning said plies at corresponding locations on first and second receiving platforms;

means for jointly engaging said plies in the vicinity of said seam tracks and for transferring said jointly engaged plies to a sewing position; and sewing apparatus for receiving said jointly engaged plies at said sewing position and for joining said plies by sewing along said seam.

55. Apparatus as specified in claim 54 wherein said sewing apparatus includes a sewing platform and wherein said joint engaging and transferring means forms a portion of said sewing platform at said sewing position.

56. Apparatus as specified in claim 54 wherein said sewing apparatus includes second means for jointly engaging said plies, a sewing machine and means for transporting said second joint engaging means and said plies past said sewing machine to join said plies along said seam.

57. Apparatus as specified in claim 56 wherein said second joint engaging means includes a plurality of projecting pins.

58. Apparatus as specified in claim 57 for sewing along a curved seam track, wherein said pins engage said plies in a curved pin track adjacent said seam track and wherein said pins transport said plies past said sewing machine in a straight path.

59. Sewing apparatus, for positioning and sewing adjacent plies of fabric in a stack of fabric plies, comprising:

a support frame having transverse and longitudinal horizontal directions;

a first support platform at one longitudinal end of said frame for holding said stack of fabric plies, said first platform being arranged for vertical motion with respect to said frame;

first platform transport means for adjusting vertical position of said first platform;

a second platform at the other longitudinal end of said frame for receiving fabric plies, said second platform having a platform portion arranged for vertical motion with respect to said frame and for longitudinal motion with respect to said frame and having vacuum apertures for engaging fabric plies on said platform;

second platform transport means for vertically positioning said second platform portion;

third platform transport means for longitudinally positioning said second platform portion;

a third platform at the other longitudinal end of said frame for receiving fabric plies, said third platform being arranged for transverse motion with respect to said frame between a first position vertically above said second platform and a second position transversely displaced from said second platform;

fourth platform transport means for moving said third platform between said first and second positions;

vacuum control means for selectively applying vacuum to said vacuum apertures;

a carriage arranged for longitudinal transport with respect to said frame over said first, second and third platforms;

carriage transport means for moving said carriage;

a roller carried by said carriage and rotatable about a roller axis having a direction transverse with respect to said frame;

roller driving means carried by said carraige and engaging said roller;

fabric ply engaging means carried by said roller;

fabric engaging chain means mounted longitudinally adjacent said other end of said frame for receiving fabric from said second platform portion and for transporting said fabric past said sewing machine;

means for driving said sewing machine;

means for driving said chain; and control means for:

operating said first platform transport means to adjust the vertical position of said first platform to a roller engaging position for the top ply of fabric on a stack on said platform;

operating said carriage transport means and said roller driving means in coordination to move said carraige from said one end of said frame toward said other end while rotating said roller to provide rolling encounter with said top ply, engagement of said top ply by said roller and wrapping of said top ply around said roller by a selected amount;

discontinuing operation of said roller driving means while continuing operation of said carriage transport means and operating said first platform transport means to lower said first platform by a selected amount, thereby to peel said first ply from said stack;

continuing operation of said carraige transport means while drawing said first ply over said third platform in said first position and selectively operating said roller driving means in a reverse direction to release said first ply in a selected position on said third platform;

reversing said carriage transport means to return said carriage from said other end of said frame to said one end;

operating said fourth platform transport means to move said third platform to said second position;

operating said first platform transport means to adjust said first platform to said roller engaging position;

operating said carriage transport means and said roller driving measn in coordination to move said carriage and said roller to engage and wrap a second ply around said roller by said selected amount;

discontinuing operation of said roller driving means while operating said carriage transport means and said first platform transport to peel said second ply from said stack;

operating said carriage transport means and said roller driving means to release said second ply in a selected position on said third platform;

reversing said carriage transport means to return said carriage to said one end;

operating said fourth platform transport means to move said third platform to said first position;

operating said second platform transport means to adjust the level of said second platform portion to engage said third platform;

operating said vacuum control means to engage said first and second plies by said vacuum apertures on said second platform portion;

operating said third platform transport means to transport said second platform portion and said plies to said chain means;

releasing operation of said vacuum control means;

operating said chain driving means and said sewing machine driving means to transport said plies past said sewing machine and sew said plies.

60. Apparatus for transporting fabric or similar material in a selected path along a surface, comprising:

an endless flexible conveying member comprising a chain which flexes about transverse link connecting axes having a plurality of transversely extending pins extending from said chain substantially parallel to said axes;

a groove on said surface along at least a portion of said path for receiving the ends of said pins;

means fior supporting said conveying member adjacent said surface along said path with said pins extending into said groove; and means for transporting said conveying member along said path.

61. Apparatus as specified in claim 60 wherein said transporting means include a stepper motor connected to a rotary member engaging said conveying member.

62. Apparatus as specified in claim 60 wherein there is provided a track for guiding said conveying member along said path.

63. Apparatus as specified in claim 62 wherein at least a portion of said track extends along a curved portion of said path.

64. Apparatus as specified in claim 60 wherein at least a portion of said surface and said groove are moveable with respect to said chain and said pins to engage and disengage fabric on said surface portion.

65. Apparatus for transporting fabric or similar material in a selected path along a surface, comprising:

an endless flexible conveying member comprising a chain having a plurality of transversely extending pins;

a groove on said surface along at least a portion of said path and extending across two portions of said surface for receiving the ends of said pins, one of said portions being movable towards or away from said chain and said pins;

means for supporting said conveying member adajcent said surface along said path with said pins extending into said grooves;

means for transporting said conveying member along said path; and a rod, parallel to and spaced from a portion of said chain adjacent said moveagle surface portion, said rod being arranged for movement with said surface to disengage fabric from said chain.

* * * * *